US006892395B2

(12) United States Patent
Schweer

(10) Patent No.: US 6,892,395 B2
(45) **Date of Patent: *May 17, 2005**

(54) SAFETY GARMENT HAVING SAFETY HARNESS

(76) Inventor: James R. Schweer, 521 N. Lake Cove, Birmingham, AL (US) 35242

( * ) Notice: Subject to any disclaimer, the term of this patent is extended or adjusted under 35 U.S.C. 154(b) by 59 days.

This patent is subject to a terminal disclaimer.

(21) Appl. No.: 10/790,090

(22) Filed: Mar. 2, 2004

(65) Prior Publication Data

US 2004/0163156 A1 Aug. 26, 2004

Related U.S. Application Data

(63) Continuation-in-part of application No. 10/337,281, filed on Jan. 7, 2003, now Pat. No. 6,698,026, which is a continuation-in-part of application No. 10/123,217, filed on Apr. 17, 2002, now Pat. No. 6,658,666, and a continuation-in-part of application No. 09/782,066, filed on Feb. 14, 2001, now Pat. No. 6,305,024.

(51) Int. Cl.[7] ..... A41D 13/00

(52) U.S. Cl. ..... 2/94; 2/69; 182/3

(58) Field of Search ..... 2/69, 94, 69.5, 2/79, 102, 44–45, 81, 327, 108, 93, 456; 182/3–6; 244/151 R

(56) References Cited

U.S. PATENT DOCUMENTS

| | | | |
|---|---|---|---|
| 2,979,153 | A | 4/1961 | Hoagland et al. |
| 3,424,134 | A | 12/1979 | Rosenblum |
| 4,177,877 | A | 12/1979 | Gallinati |
| 4,273,216 | A | 6/1981 | Weissmann |
| 4,302,847 | A | 12/1981 | Miles |
| 4,731,882 | A | 3/1988 | Ekman |
| 5,050,704 | A | 9/1991 | Olsson |
| 5,136,724 | A | 8/1992 | Grilliot et al. |
| 5,145,027 | A | 9/1992 | Petzl et al. |
| 5,289,590 | A | 3/1994 | Larson |
| 5,445,114 | A | 8/1995 | Walker |
| 5,738,046 | A | 4/1998 | Williams et al. |
| 5,970,517 | A | 10/1999 | Jordan |
| 6,035,440 | A | 3/2000 | Woodyard |
| 6,101,631 | A | 8/2000 | Ferguson, Jr. |
| 6,128,782 | A | 10/2000 | Young et al. |
| 6,189,651 | B1 | 2/2001 | Sadeck |
| 6,244,379 | B1 | 6/2001 | Larson |
| RE37,394 | E | 10/2001 | Woodyard |
| 6,305,024 | B1 | 10/2001 | Schweer |
| 6,637,547 | B1 | 10/2003 | Wydner |
| 6,658,666 | B2 | 12/2003 | Schweer |

FOREIGN PATENT DOCUMENTS

| | | |
|---|---|---|
| GB | 1233761 | 5/1971 |

*Primary Examiner*—Tejash Patel
(74) *Attorney, Agent, or Firm*—Richard C. Litman

(57) ABSTRACT

The safety garment for industrial and construction workers, and hunters incorporates a safety harness in to the body of a jacket, coat, or other apparel. The garment has a safety harness with a central attachment ring receiving a safety line, anchoring a wearer to a beam or tree trunk. The safety harness may be sewn on the outer or inner surface of a removable, reversible inner liner or a vest, or can be attached to an outer shell such as an outer vest, jacket, shirt, parka, or other garment covering the harness. The vest may be blaze orange on one side and camouflage patterned on the other. During a fall, pulling forces on the harness are equalized in both directions, providing maximal distribution of force on the wearer. The waist belt or other portion of the safety harness has attachments for removable leg loop/crotch straps and other removable accessories.

43 Claims, 34 Drawing Sheets

SAFETY GARMENT HAVING SAFETY HARNESS

CROSS-REFERENCE TO RELATED APPLICATIONS

This application is a continuation-in-part of application Ser. No. 10/337,281, filed Jan. 7, 2003, now U.S. Pat. No. 6,698,026, which is a continuation-in-part of application Ser. No. 10/123,217, filed Apr. 17, 2002, now U.S. Pat. No. 6,658,666, and is continuation-in-part of application Ser. No. 09/782,066, filed on Feb. 14, 2001 now U.S. Pat. No. 6,305,024 issued to the present inventor, James R. Schweer.

BACKGROUND OF THE INVENTION

1. Field of the Invention

The present invention relates generally to articles of clothing and more specifically to a safety garment for industrial or construction workers and hunters.

2. Description of Related Art

Numerous articles of clothing have been devised for enhancing the safety of their wearers. Over the years, some of the most significant advances in the art have involved safety devices directly incorporated into a piece of clothing. However, none of the techniques described hereinbelow results in a garment, which incorporates a safety harness, which allows workers or hunters to reliably secure themselves to a support structure or, in the case of a hunter, a tree, particularly when the hunter is positioned at some height above the ground. Moreover, none of the references herein described presents a garment having provision for removable leg loop/crotch straps and/or providing a selectively removable and reversible liner in a garment enabling workers or hunters to be able to quickly put on the requisite safety gear when on the job or in the field.

For example, U.S. Pat. No. 5,738,046, describes a safety jacket and harness system, including a body harness formed by a pair of torso bands and a pair of shoulder straps. The torso bands form an upper torso band and a lower torso band. Each torso band has a fastening member attached to end portions. The pair of shoulder straps each has a first shoulder strap portion and a second shoulder strap portion. Each shoulder strap portion is coupled together by a fastening member. Included is a center strap that is fixedly attached to the torso bands and has a locking member at a top end. A safety strap has a first safety strap end that can couple with the locking member of the center strap, and a second safety strap end that can be looped and fastened around a tree trunk. An attachment strap is attached to the safety strap. A jacket receives the body harness when worn by a hunter using a tree stand with the center strap of the harness coupled to the attachment strap looped around the trunk. Similarly, in the case of an industrial or construction worker the attachment strap is attached to the safety strap and a structure such as a beam.

U.S. Pat. No. 6,637,547, issued Oct. 28, 2003, to Wydner describes a safety hunting harness and garment, the garment being disclosed as a harness sewn into a vest having a safety strap disposed vertically within the vest back having attachment rings at its upper and lower ends and having shoulder straps and waist and upper torso straps held by the safety strap and the shoulder straps within loops therein allowing adjustment of the waist and upper torso straps during fastening of buckles thereon.

U.S. Pat. No. 6,101,631, issued Aug. 15, 2000, to Ferguson, Jr., describes a full-body harness system which is located between an outer shell and an inner liner and having a back located D-ring extending from the outer shell for attachment to a safety line, the D-ring being covered when not in use by a flap.

U.S. Pat. No. 5,970,517, issued to Jordan, describes a harness assembly having an integral support line. The harness assembly includes a harness body having first and second ends that extend from the harness body. The harness is secured within a garment. The garment has a front opening, which is normally covered by a releasable flap. The first and second ends of the support line extend through the front opening and are accessible when the flap is moved to an open position. The first end of the support line may be pulled away from the harness to extend the support line therefrom. The second end of the support line is secured to the harness.

U.S. Pat. No. 6,128,782, issued Oct. 10, 2000, to Young et al. describes a combination clothing/safety harness. The safety harness may be attached to various articles of clothing, such as a jacket, vest, overalls, or coveralls, so that donning the article of clothing automatically positions the harness for use.

U.S. Pat. No. 6,035,440, issued to Woodyard, discloses a safety vest which incorporates a safety harness between a vest inner lining and a vest outer shell with attachment couplers and rings incorporated in the vest in vest pockets that store the attachment couplers and rings out of sight in communicating between the harness and a lanyard external to the vest.

U.S. Pat. No. 2,979,153, issued to E. J. Hoagland et al., describes a safety suit for supporting a person's body in an upright manner during hoisting, including a garment arranged to extend around the torso of a body and a plurality of annularly extending straps defining body embracing nooses.

U.S. Pat. No. 4,177,877, issued to Gallinati, describes a vest adapted to be worn by a workman operating at perilous heights. The vest has straps between the lining and the outer fabric. The straps have crossed sections in the back of the garment and vertical sections in the front panels.

U.S. Pat. No. 4,273,216, issued to Weissmann, describes a safety jacket adapted to have a line secured thereto for anchoring the wearer of the jacket in the event he loses his footing. The jacket includes a harness having a pair of shoulder straps and a belt made of polypropylene, which is threaded through loops at the ends of the shoulder straps.

U.S. Pat. No. 4,302,847, issued to Miles, describes body protective clothing to be worn over or in place of outer garments for protection while actively participating in various sports. A zippered vest-type garment including a resilient foam insert along the lower portion of the torso includes adjustable front closure straps for maintaining the position of the foam about the lower back and hip bones.

U.S. Pat. No. 4,731,882, issued to Ekman, describes a garment that is connectable to a safety line or the like and which includes at least one band, which is intended to take up the weight of a person wearing the garment.

U.S. Pat. No. 5,136,724, issued to Grilliot et al., relates to a firefighter's trousers and safety harness combination. At least a portion of the safety harness is positioned and supported within the firefighter's trousers.

British Patent No. 1,233,761 shows a safety harness having integral seat and jacket portions, the seat portion including couplers whereby the harness can be suspended from wires or ropes and the jacket portion including sufficient buoyancy to keep the wearer of the harness afloat if dropped into water.

U.S. Pat. No. 5,145,027, issued Sep. 8, 1992, to Petzl et al. describes a sit safety harness with high loops in the form of closed loops fitted on a belt with a central clasp.

U.S. Pat. No. 5,289,590, issued Mar. 1, 1994, to Larson, describes a combined work trousers and safety harness having leg loops.

U.S. Pat. No. RE 37,394 E, issued Oct. 2, 2001, to Woodyard describes a safety vest incorporating a safety harness with leg loops.

U.S. Pat. No. 6,244,379, issued Jun. 12, 2001, to Larson, describes an automatically adjustable safety harness having leg loops.

U.S. Pat. No. 5,050,704, issued Sep. 24, 1993, to Olsson, describes a climbing loop clipped to harness rings on a harness worn by a climber.

U.S. Pat. No. 6,189,651, issued Feb. 20, 2001, to Sadeck, describes a harness having a belt and leg loops.

U.S. Pat. No. 3,424,134, issued Jan. 28, 1969, to Rosenblum, describes a safety harness having leg loops.

None of the above inventions and patents, taken either singly or in combination, is seen to describe the instant invention as claimed.

SUMMARY OF THE INVENTION

The safety garment for industrial and construction workers, hunters, naturalists, and other outdoorsmen provides a garment, which incorporates a safety harness into the body of a jacket, coat, or other apparel. The safety garment protects workers when working at dangerous heights or near dangerous machinery from injury from falling and allows hunters using elevated positions such as trees or tree stands to focus on the sport, instead of worrying about falling. The safety garment is made up of a safety harness with a central attachment ring for receiving a safety rope or line for releasably anchoring a wearer to an anchor point such as a beam or the trunk of a tree. The safety harness is preferably sewn or otherwise located within or on the outer surface of an inner liner or vest which is preferably selectively removably attached to an outer shell in the form of an outer vest, jacket, shirt, parka, or other garment. Alternatively, the safety harness may be sewn or otherwise located or secured into the inside surface of the outer shell. In a third embodiment, the safety harness is merely encased between the outer shell and the inner liner, and is free to move relative to both the shell and the liner. In each embodiment the harness is fully covered so that it is essentially invisible from the outside.

The harness includes a waist belt and matching belt coupler on the belt ends which may be releasably interlocked as a buckle. The belt ends extend out from under the inner lining of the safety garment, the inner lining in the preferred embodiment being selectively removable. An opening is provided in the upper mid-portion of the safety garment outer shell's back, defining a pocket which passes through the safety garment's outer shell and has associated with it a flap, which acts to cover or overlie the opening. A safety strap having an attachment ring securely fastened thereon and being of a length sufficient to pass from the harness through the shell opening to the outside of the safety garment outer shell is also provided as part of the safety harness, the safety strap extending upward from the waist belt. The pocket serves as a cavity in which the ring, as well as its associated strap, is stored when not in use. Removable leg loop/crotch straps may be provided which attach in a variety of alternative ways to the waist belt of the harness. The use of leg loop/crotch straps with the safety harness as included in the garment jacket or vest is preferred in order to distribute the forces over the body during an arrested fall in order to protect the upper body from excessive force applied upon arrest of the fall. Such excessive force may, in some instances, tend to suffocate the wearer or cause bruises or broken ribs.

The harness includes a pair of shoulder straps or loops, each having respective ends attached to the waist belt and each forming front and back shoulder loop or strap portions. In one embodiment the back shoulder loop portions converge to intersect in the rear portion of the back to form a juncture connection. Underarm straps may also be provided extending laterally to connect a respective pair of adjacent front and rear shoulder loop portions. Thus, the harness includes crossed back sections and vertical front sections. The crossed back sections may be interconnected intermediate their ends in the juncture connection which is positioned intermediate the neck portion and the lower edge of the vest and medially between the sides. The safety strap is fixedly attached to the harness at this juncture and also at the waist belt at the point of intersection with the midline of the back.

In the event the harness is in use, such as during a fall or when dragging a deer carcass, the pulling forces on the harness are equalized in both directions, providing maximally efficient distribution of force on the body harness. In a lighter duty embodiment the back sections end at the juncture in the manner of conventional pants suspenders. In another embodiment, shoulder straps simply extend from the front of the belt, to the rear of the belt. One or more additional belts with buckles spaced upward along the torso may be added to each of the embodiments, the safety strap being fastened to the back thereof as desired.

Accordingly, it is a principal object of the invention to provide a safety garment having a safety harness incorporated therein.

It is another object of the invention to provide a safety garment whereby the placement of safety harness may be easily and more comfortably worn by a worker or hunter and positioned for maximum positive effect.

It is a further object of the invention to provide a safety garment wherein the harness is designed to work in combination with the inner layer and outer layers of the garment to increase the wearer's safety.

It is yet another object of the invention to provide an inner layer as above in the form of a liner which is selectively removable from the outer layer in the form of an outer shell.

Still another object of the invention is to provide a safety garment, which safely arrests the fall of the worker or hunter during an accident.

It is a further object of the invention to provide an improved garment, which restrains the wearer from falling into dangerous machinery or keeps the wearer from falling from vehicles such as forklifts.

It is yet another object of the invention to provide a garment as above having attachments for removable leg loop/crotch straps for attachment to the waist belt of the safety harness.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a safety garment for industrial and construction workers and hunters, naturalists, and other outdoorsmen by providing a combination garment and harness.

Figure 1:
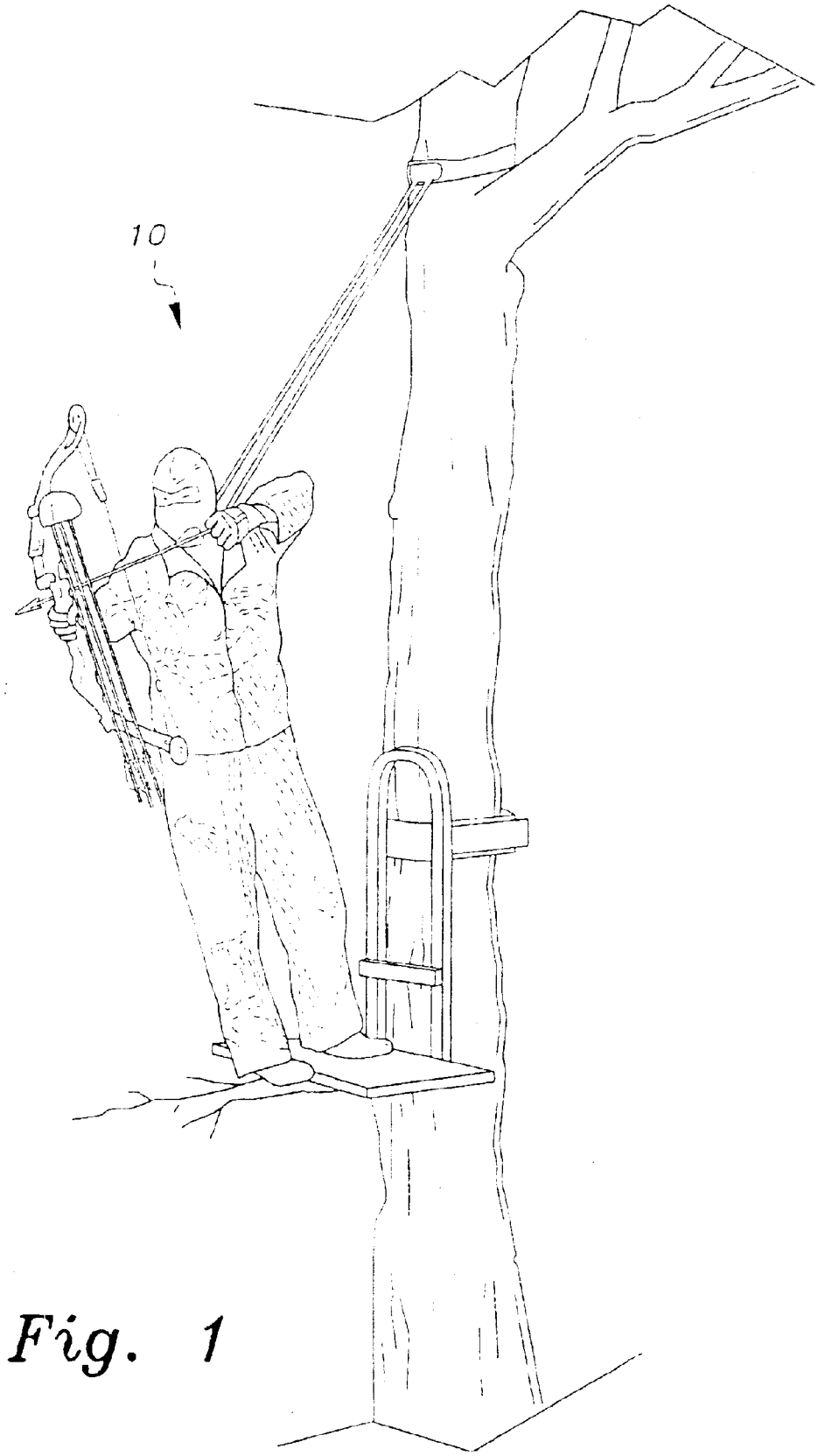
FIG. 1 is an environmental, perspective view of a safety garment, according to the present invention.

As diagrammatically illustrated in FIG. 1, an environmental view in which a Hunter H is readying himself for the kill is shown. The hunter H, is shown wearing the safety garment 10. The hunter H is safely suspended from a tree T by a safety line attached to the invention, which provides him with a stable and secure line to keep him from falling from his tree stand X in case of a misstep. The safety garment 10 allows the hunter H to focus on the sport, instead of worrying about falling. Similar scenarios are apparent such as a worker wearing the safety garment 10 working as a tree surgeon or as a construction worker or roofer on tall structures. Every year thousands of deer hunters are crippled, paralyzed, or even killed after falling from trees or elevated tree stands. Some statistics indicate that as many as two thirds of hunters fail to wear safety equipment when climbing or descending, or when entering or exiting their stands. While many hunters are aware of the safety advantages of wearing harnesses during climbing or when descending from a tree, they report that they fail to do so, because the harness gets in the way of the stand as they climb or they simply do not want to spend the time dealing with it. Commentators have observed that this complacency in hunters may come from a lifetime of having climbed trees and ladders without safety restraints, and then carrying over this behavior to the woods, where trees and tree stands are unstable and natural vegetation can provide an unrealistic sense of relative height above ground.

The International Hunter Education Association reported 19 deaths from tree stand falls in 1997, the last year for which statistics were available. Currently it is estimated that more than 37 percent of hunters using tree stands have fallen at least once. The present invention presents an excellent solution to this problem by providing a safety strap/harness, which is incorporated directly into the body of a safety garment. And, as shown in FIG. 1, this can include any kind of apparel, such as a jacket 12, and/or a pair of trousers 14. Furthermore, any kind of harness may be used, though a preferred harness system is herein described.

In a recent report published from Wright-Patterson Air Force Base in Ohio, it was shown that volunteers suspended in mid air while wearing safety belts began to become unconscious in anywhere from 30 seconds to up to 4.5 minutes, while test subjects wearing chest harnesses began to lose consciousness in between one and 13 minutes. The present invention provides an important improvement by incorporating a safety harness directly into the structure of a hunting jacket, creating better distribution of pressure on the subject's torso in case of accidental fall.

Falling injuries may also be sustained by workers in mining, construction, roofing and other industries. The present inventive harness-containing jacket 12 and trousers 14 presents the same advantages to the worker as the hunter H depicted in FIG. 1 and described above.

The safety garment 10 of the present invention comprises a safety harness with a central attachment ring for receiving a safety rope or line for releasably anchoring a wearer of the safety garment to an anchor point such as the trunk of a tree or other structure. An important advantage of the safety garment 10, from both an aesthetic and practical viewpoint, is that it is disposed and preferably sewn directly onto the removable liner of the vest, jacket, or garment outer shell which fully covers the harness so that it is essentially not visible from the outside. By the harness being tightly incorporated into the safety garment, an important advantage is realized in that it may be easily adapted to fit around a wearer's torso in the manner of putting on and suitably adjusting a conventional jacket to fit. Thus, the combination jacket/safety harness is an important contribution to the art which provides an ideal level of safety and comfort to users.

Figure 2A:
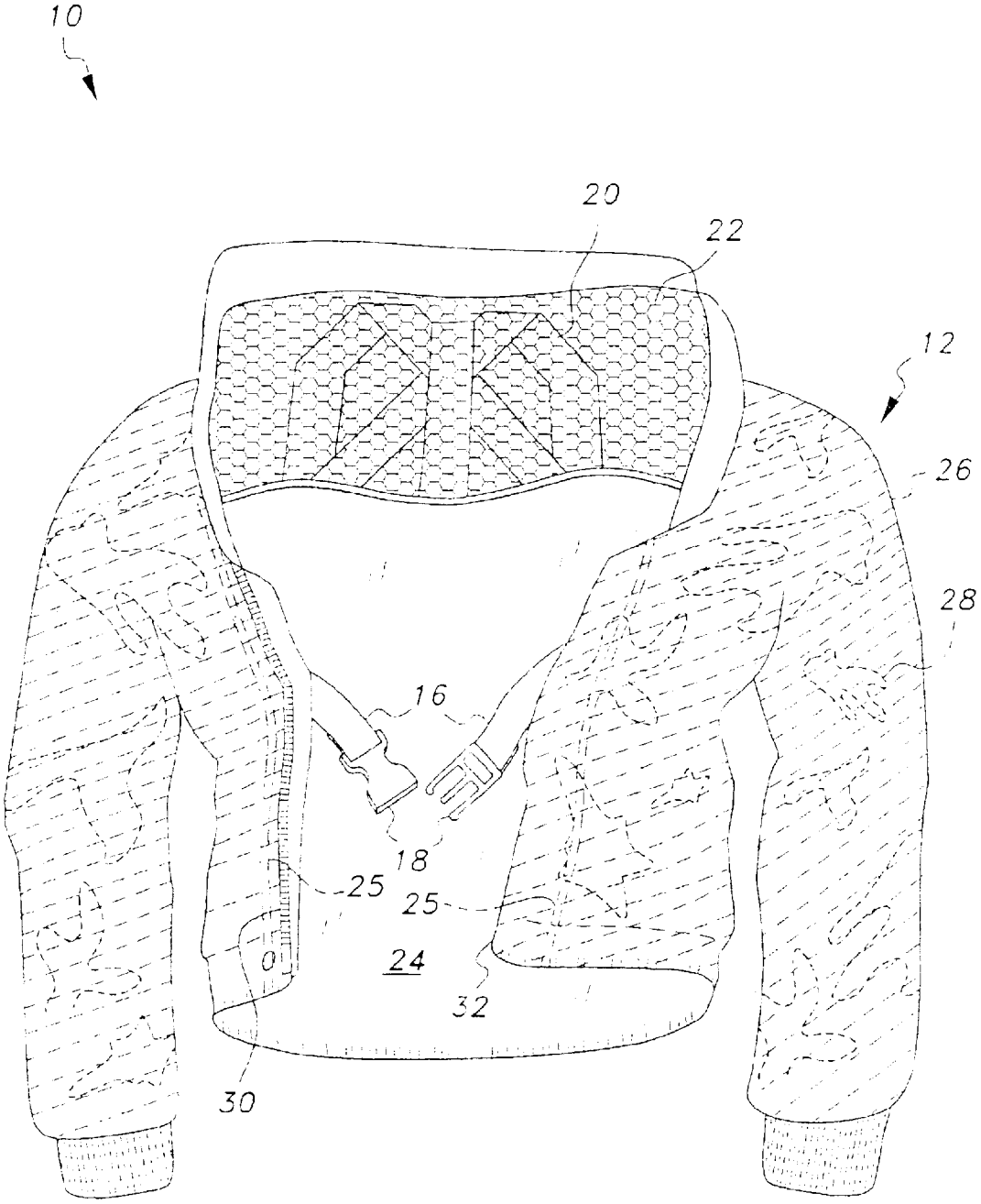
FIG. 2A is an exterior front view of the safety garment, according to the present invention.

Referring now to FIG. 2A, it can be seen that the jacket 12 includes a waist belt 16 and matching belt couplers 18 on the belt ends which may be releasably interlocked as a buckle. The belt couplers or buckle 18 are part of the harness 20 (partially obscured by the mesh netting indicated by 22) and also preferably made of plastic, which is much quieter than metal devices, which can create noise and scare game animals. As shown, the belt 16 ends extend out from under the inner liner 24 of the safety garment jacket 12, the inner liner 24 in the preferred embodiment being selectively removable and may be worn independently of the garment jacket 12. The inner liner 24 is also reversible, having a bright color on one side or surface such as blaze orange, and camouflage designs on the other side or surface.

As explained in greater detail hereinbelow, the waist belt 16 is connected to the harness 20, the general arrangement of which, again, can be partially seen folded over itself through the netting 22. This netting 22 may form a portion of the inner liner 24 of the safety garment jacket 12 or be entirely independent thereof. The netting 22 is preferably made of a mesh having a loosely knit construction to facilitate proper air and moisture ventilation. The outer shell 26 of the jacket 12 preferably has pockets with openings (not shown) in the outer shell 26 through which the ends of the waist belt 16 may pass from inside the safety garment liner 24 to the outside of the safety garment shell to provide a neat appearance. The present invention may also include an adjustable hood (not shown).

The conventional worker or hunter's coat is less than ideal not only for the disruption and inconvenience it provides when having to put a separate safety harness on but also because of the problem which arises when human body odors, the detection of which is the first line of defense for many animals, are released into the environment when opening or taking off a garment, "spooking" game even after a hunter leaves the area.

Of course, these problems are not limited to hunters who like to stalk their game. Bird-watchers, who, commonly, want to see a wide array of species on an outing, will sometimes mount tree stands to get a better view. The present device allows a bird-watcher to quickly, safely, and "scentlessly" blend into the background, providing him an enormous advantage.

As seen in FIG. 2A, there is shown a frontal view of the safety jacket 12. Adjacent and along a line substantially parallel to the seam line is a zipper, generally 30, for reversibly attaching to mating elements (not shown)

approximately located adjacent mating seam line 32. Portions of liner zippers 25 (hidden lines) are positioned to receive the mating parts of liner zippers 25 (see FIG. 2B). This arrangement of zippers allows the liner 24 to be reversibly mounted within the safety jacket 12. It should be understood that though specific fastening elements are described for the preferred embodiment, fasteners of any kind or combination commonly known in the art and in conventional usage may be substituted.

Figure 2B:
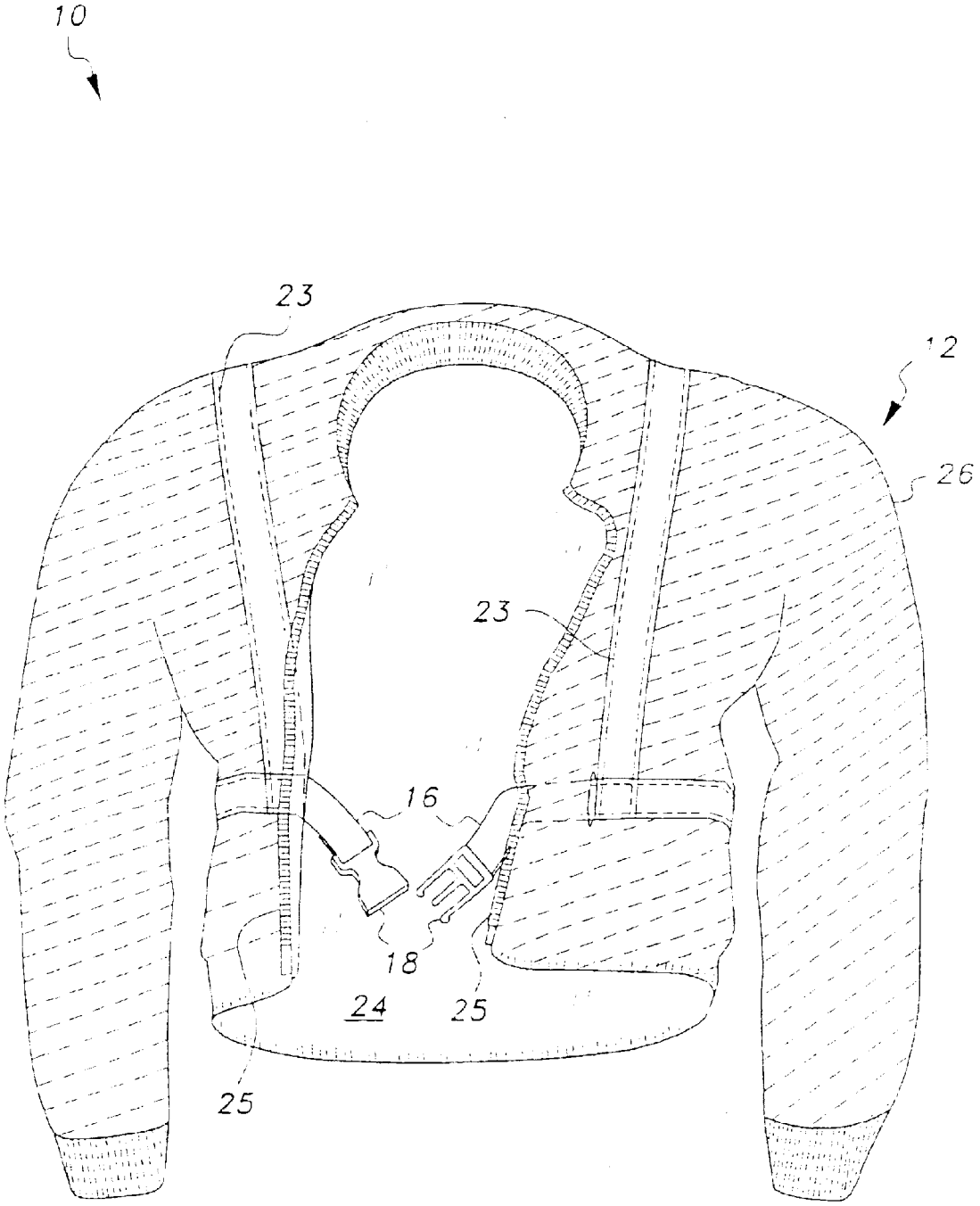
FIG. 2B is an exterior front view of an inner lining without mesh as removed from the outer shell of the safety garment of FIG. 2A.

Referring to FIG. 2B, there is shown the removable liner 24 of the safety jacket 12 showing the harness 20 attached thereto such as by stitching 23 and portions of peripheral liner zippers 25 for installation and removal of the liner from the outer shell 26 corresponding to a mating zipper portions 25 in FIG. 2A (not shown) in a well-known manner. The removable liner 24 may be attached to outer shell 26 by alternative means such as hook and loop material (VELCRO) patches, buttons, or snaps. The liner 24 may take the form of a vest for use in warmer weather. The liner 24 may be worn separately without the outer shell 26 as desired in warmer weather and is reversible with camouflage on one side for bow hunting, and a bright color on the other such as blaze orange for rifle hunting or as a safety garment.

Figure 3:
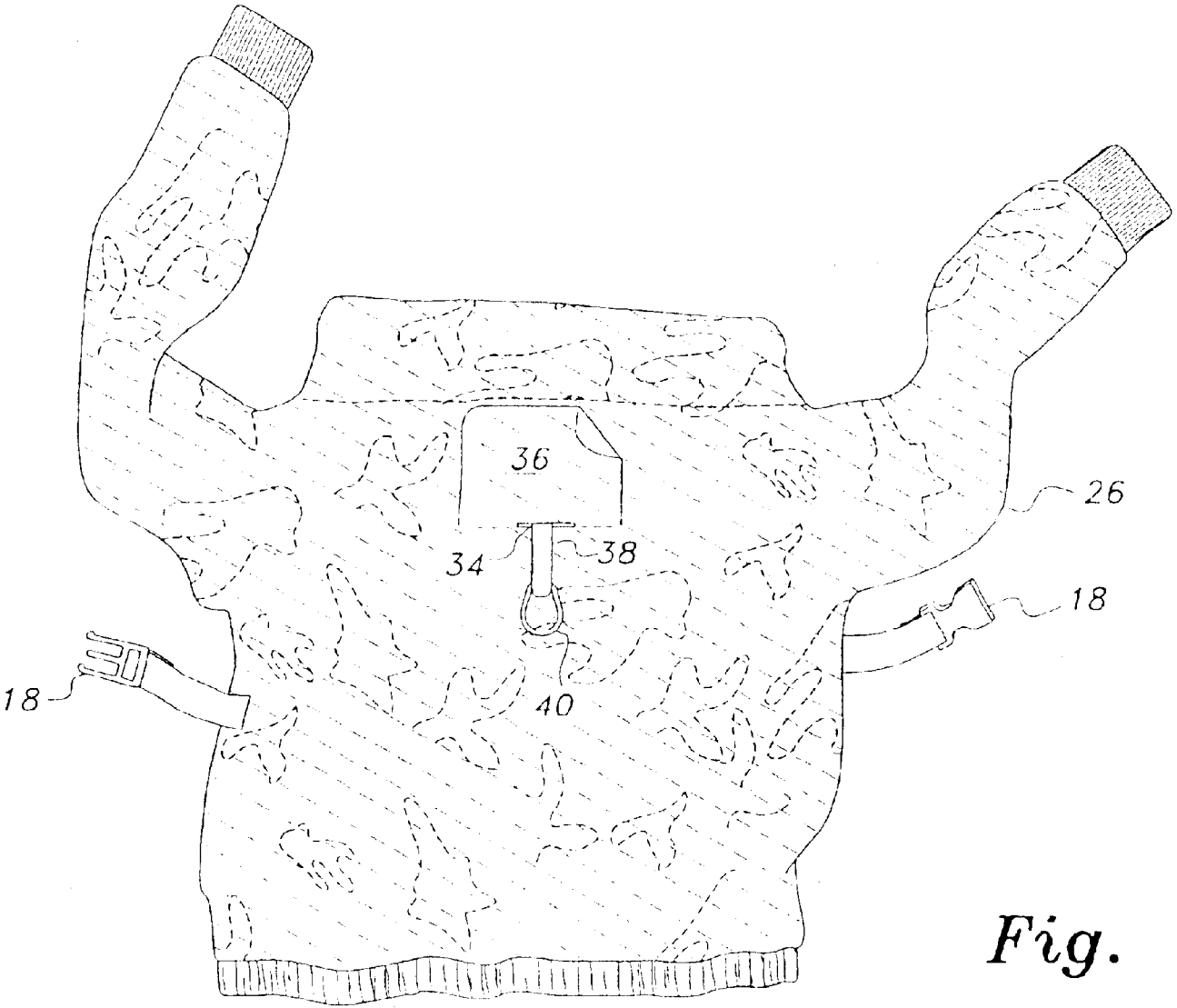
FIG. 3 is an exterior rear view of the safety garment, according to the present invention.

Turning now to FIG. 3, an opening 34 is provided in the upper mid-portion of the back of safety garment jacket 12 defining the upper open end of a pocket (not shown). The opening 34 passes through the safety garment's outer layer or shell 26 and has associated with it a flap 36, which acts to cover or overlie the opening 34. A safety strap 38 having an attachment ring 40 securely fastened thereon is of a length sufficient to pass from the harness (not shown) through the opening 34 to the outside of the safety garment outer shell 26. The pocket serves as a cavity in which the ring 40, as well as its associated strap 38, is stored when not in use. The opening 34 is normally covered by the flap 36, which is preferably releasable. The flap 36 is optional and may be deleted from the jacket outer shell 26 when not necessary, such as when the safety garment is used in industrial applications within buildings.

In the preferred embodiment, the outer layer or shell 26 may be laundered separately from the removed inner layer or lining 24 and attached harness 22, allowing the outer layer 26 to be infrequently cleaned, thereby protecting the clarity of any particular camouflage patterns or other markings from washout. This attribute responds to the long felt problem in the art of camouflage patterns becoming less distinct and more blurry after being cleaned, sometimes even after just a few washes, making them significantly less effective.

Some importance should be ascribed to the material out of which the outer layer 26 is made. Preferable materials, thus, would be synthetic textiles, such as polyester or polyamide materials. Alternatively, more conventional materials may be used having synthetic filaments incorporated therein for strength and flexibility.

Ideally, the material out of which the entire suit 10 is made would be quiet upon movement to allow for efficient stalking of game or bird watching. The inner layer or shell 24 may be made of any suitably durable substance, including cotton, wool, polymeric material, a synthetic blend or even a lightweight polyester fabric for easy carrying and storage. In alternative embodiments, the outer shell 26 may also have draw cords for a more snug fit, as well as elastic throughout. The entire garment 10 should be machine washable and may include different sized mesh backing 22 to allow for air flow while preventing the ingress of insects.

Figure 4A:
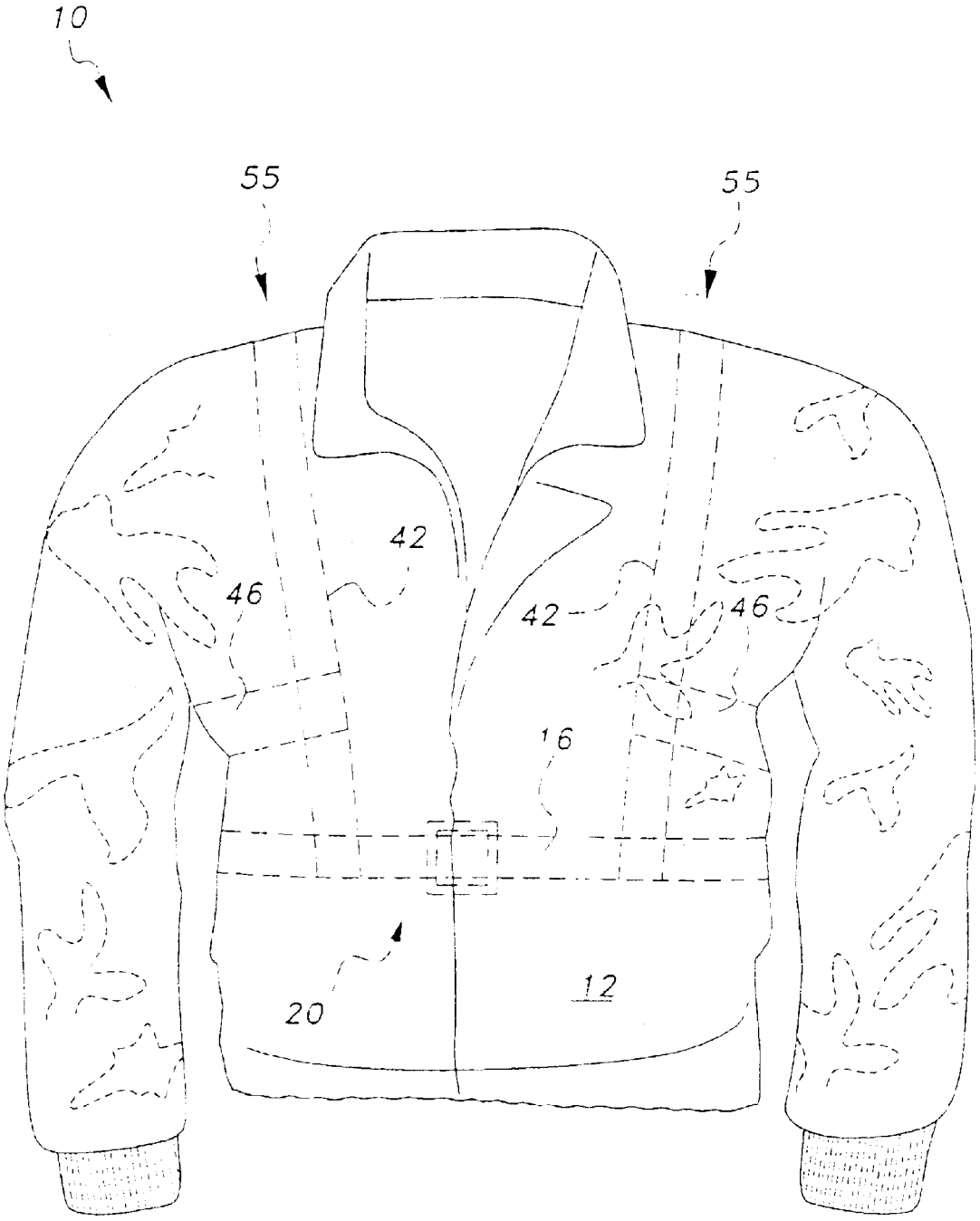
FIG. 4A is a front view of the safety garment, showing the front portion of the harness in ghost lines, according to the present invention.
Figure 4B:
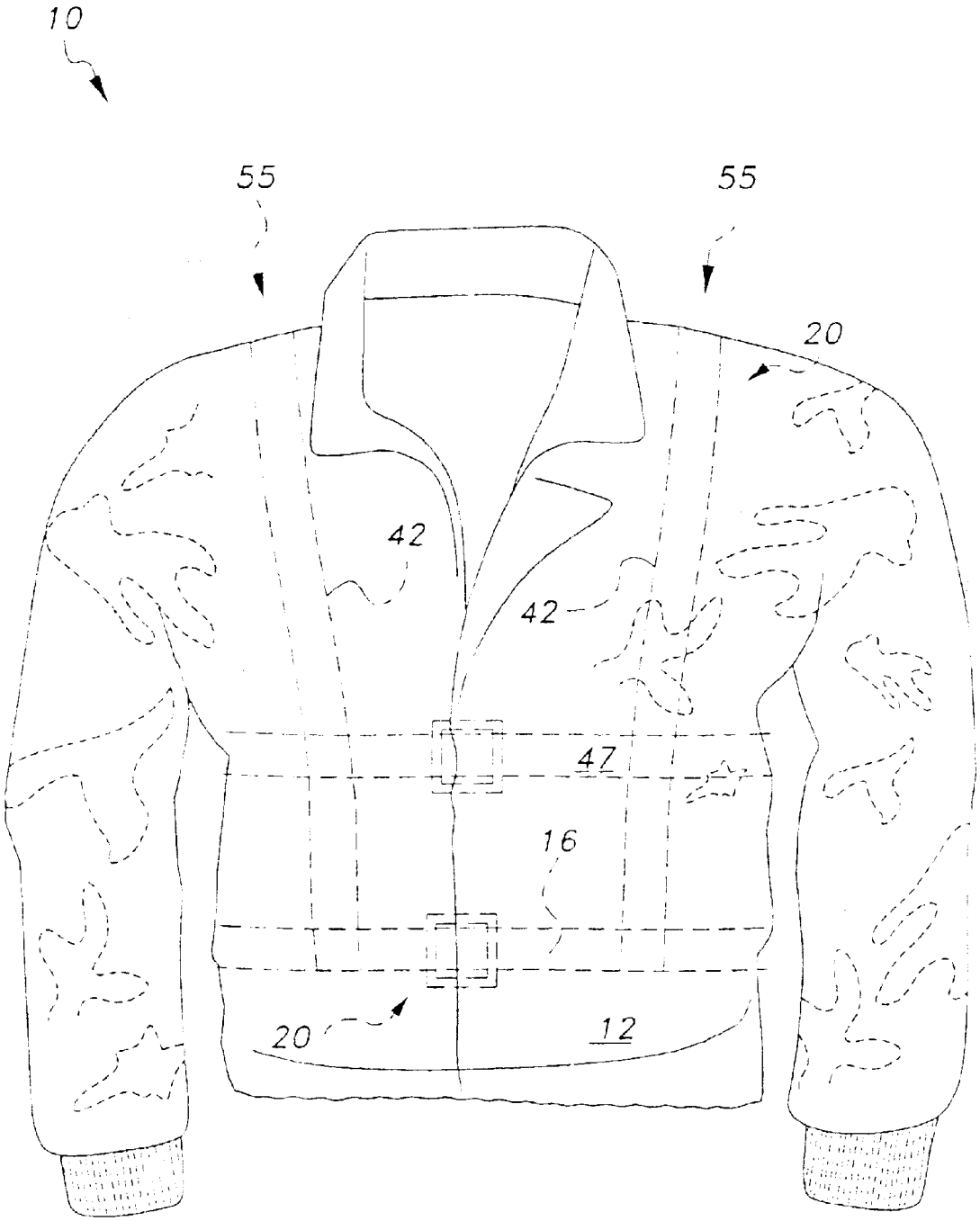
FIG. 4B is a front view as in FIG. 4A showing an alternative embodiment wherein the harness has two belts spaced along the torso portion of the safety jacket.
Figure 4C:
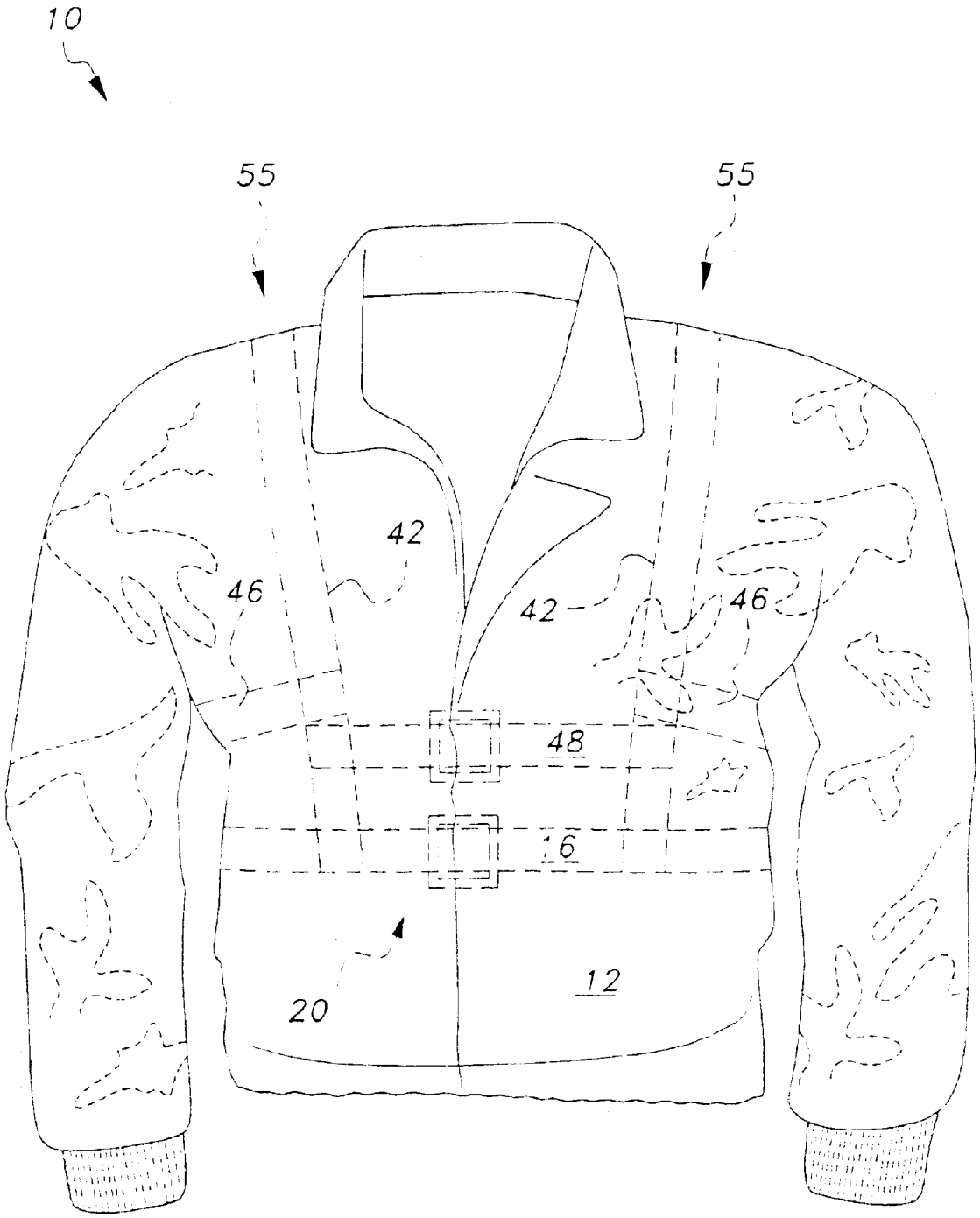
FIG. 4C is a front view as in FIG. 4A showing an alternative embodiment wherein a second belt spaced above the first belt extends between the front portions of the shoulder belts.
Figure 5A:
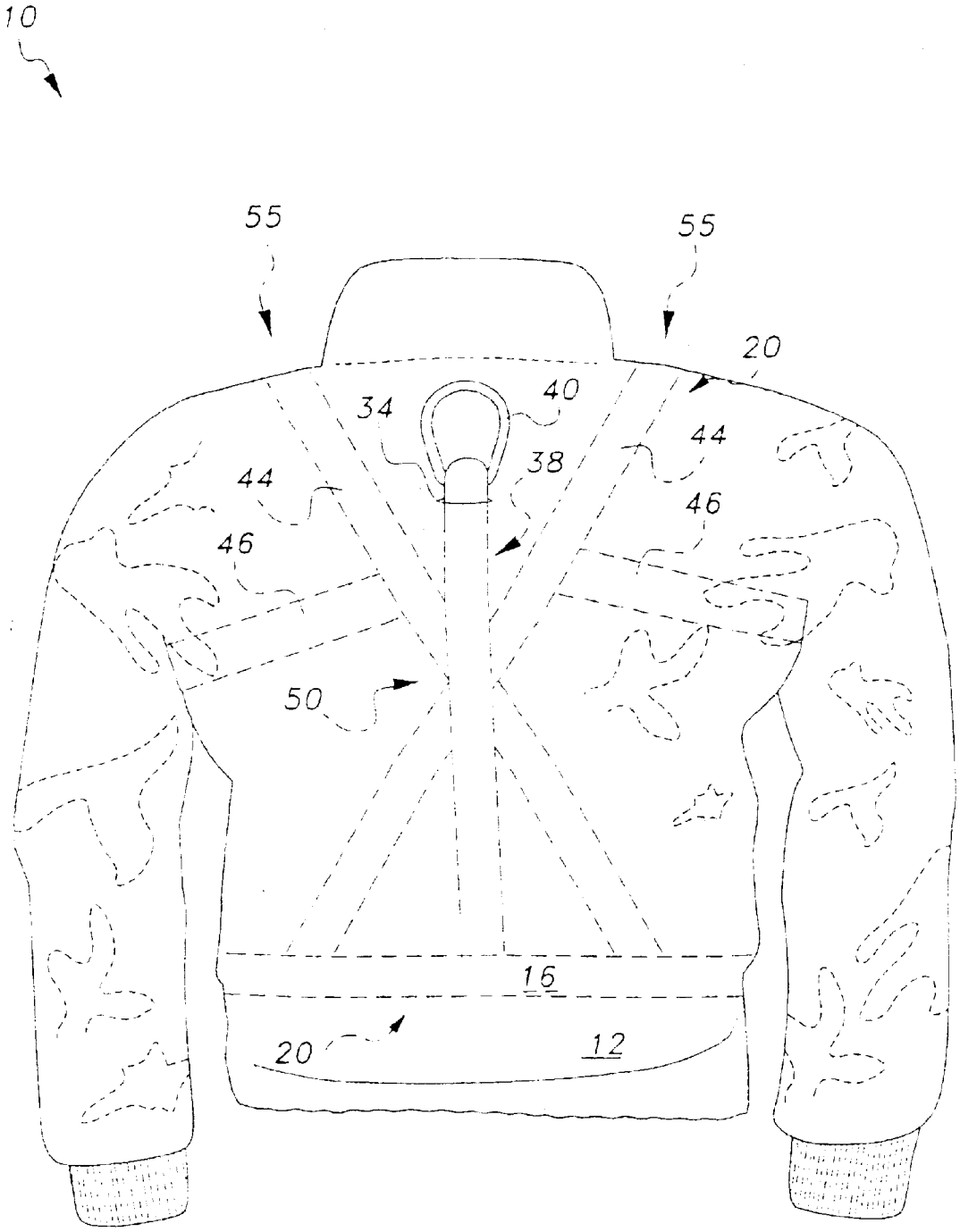
FIG. 5A is a rear view of the safety garment, showing the rear portion of the harness in ghost lines and with the flap removed, according to the present invention.

Turning now to FIGS. 4A–4C and 5A–5C, there are shown front and rear views of differing embodiments of the safety jacket 12 portions of safety garment 10 without the flap 36 with the respective front and rear portions of differing embodiments of the harness 20 shown in ghost lines. As shown in FIGS. 4A and 5A it can be seen that the harness 20 includes a pair of shoulder straps, each generally 55 and having strap ends attached to the waist belt 16, and each forming a front shoulder loop portion 42 and a back shoulder loop portion 44, disposed over the wearer's shoulders. In a preferred embodiment the back shoulder loop portions 44 converge to intersect in the rear portion of the back, substantially as shown. Underarm straps 46 are also provided extending laterally to connect a respective pair of adjacent front 42 and rear 44 loop portions, substantially as shown. Thus, the harness 20 includes crossed back sections and vertical front sections. The crossed back sections are interconnected intermediate their ends in a juncture connection 50 which is positioned intermediate the neck portion and the lower edge of the inner liner 24 and medially between the sides. The safety strap 38 is fixedly attached to the harness 20 at this juncture 50 and also at the waist belt 16 at the point of intersection with the midline of the back.

Figure 5B:
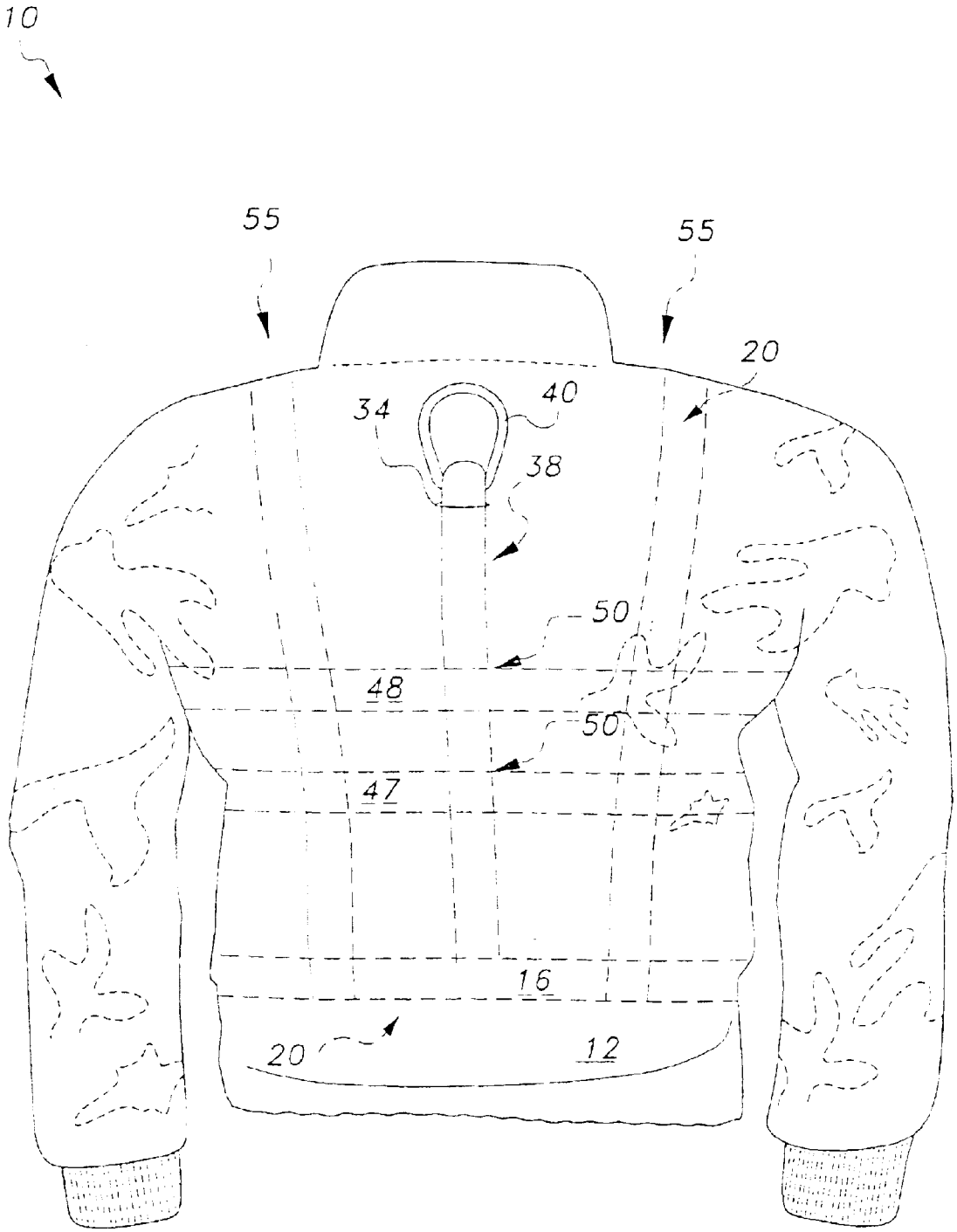
FIG. 5B is a rear view as in FIG. 5A showing an alternative embodiment of FIG. 4A wherein the harness has two belts with buckles spaced along the torso portion of the safety jacket.

Referring to the embodiment of FIGS. 4B and 5B there is shown an alternative embodiment wherein the harness 20 includes a second belt 47 extending around the upper part of the torso and spaced upward from waist belt 16. As seen in FIG. 5B, a cross strap 48 extends between shoulder belts 55 and is spaced above second belt 47, intersecting with and attached to safety strap 38 at a junction 50. Second belt 47 also intersects with and is attached to safety strap 38 at a junction 50. The harness 20 may include additional belts along the torso as desired. In another embodiment, as seen in FIG. 4C, an additional front belt 48 and buckle may be spaced above waist belt 16 and extended between the front portions of shoulder belts 55. For lighter duty, second belt 47 may be deleted from the harness 20 leaving waist belt 16 and cross strap 48 joined with safety strap 38.

Figure 5C:
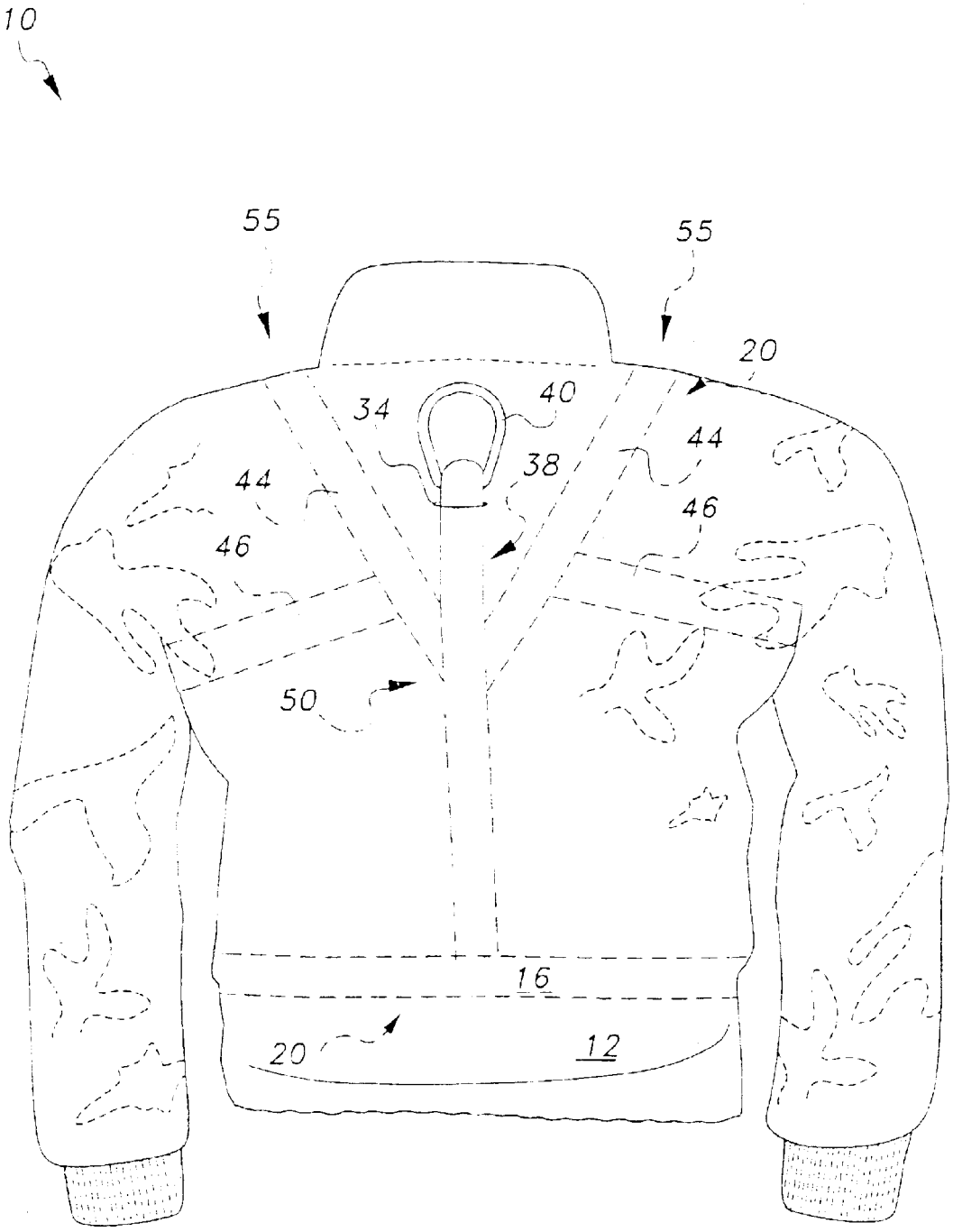
FIG. 5C is a rear view as in FIG. 5A showing another embodiment wherein the harness shoulder straps end at the junction of the shoulder straps and the safety strap.

Referring to FIG. 5C a lighter duty harness for uses where the entire weight of the wearer would not be arrested during a fall is shown. This embodiment is identical to that of FIGS. 4A and 4B except that the shoulder straps 55 end at the junction 50 with safety strap 38. Additional torso belts may be added to the harness 20 as desired.

In the event the harness 20 is in use, such as during a fall or when dragging a deer carcass, the pulling forces on the harness 20 are equalized in both directions, providing maximally efficient distribution of force on the body harness 20. The structure of the safety garment 10 together with the structure of the harness 20 assures a proper positioning of the straps 55 during wear. Thus, when the safety garment 10 is in use, the safety system is also initiated (once the front buckle or clasp is closed) in contrast to the conventionally used systems, that use two separate pieces—a safety harness and a garment alone. However, it should be understood that although the structure of the harness 20 is particularly well suited for the physical requirements described herein, this specification embraces any structural design for the harness 20 wherein an article of clothing has a harness incorporated within between an outer shell and a removable liner.

In addition to the above mentioned structural characteristics, the safety garment may also be provided with pockets, or any other conventional accouterment typically associated with apparel, especially that used for hunting or for tools or gloves. The various pockets include the front waist pockets with openings in the outer shell 26 through which the waist belt ends 18 may pass from the interstices of the safety garment to the outside of the safety garment shell 26. The outer shell also includes any and all variations in size and design, such as parkas, heavy coats, rain jackets, wind breakers, vests and the like, for both portly men and women, and children. And so in alternative embodiments, the safety garment 10 may be in the form of overalls or a one piece jacket and trousers, as well as other conventionally known garments, such as a hoodless jacket, vest, shirts, pants, and headgear or any combination thereof.

Now it may be understood how a user would implement the safety garment 10 in the field; whenever a hunter H would wish to use the invention to support himself, he would need only to casually reach over his back, lifting the flap 36, to pull out the ring 40, neatly stored just inside the safety garment 10 and manually accessible. The ring 40, which is preferably made of steel coated with rubber, can then be easily attached to a safety line. The safety garment 10 could then be easily engaged before mounting a tree stand, the nylon straps of the harness 20 being sufficiently strong and the safety strap 38 being of sufficient length to allow for maximum convenience for the wearer. The industrial user may employ the safety garment in a similar way, attaching the ring 40 of safety strap 38, which is secured to a support member.

Although camouflage garment patterns are preferred for hunting, the inventive garment may include any color and color pattern, e.g., solid color such as blaze orange, etc. in hunting and industrial settings.

The harness is preferably sewn inside the jacket, i.e., between the liner and the outer shell, but alternative arrangements are contemplated by the present invention, such as attachment of the harness inside the jacket to the inner liner using hook and loop material (VELCRO), adhesive or stitching, or allowing the harness to be free of connection to either garment portion. The harness may be attached in a similar manner to the inner liner as interchanged among other garments as mentioned above.

It is further contemplated by the invention that a pre-existing safety harness system may be inserted between the jacket and the liner in any manner described above.

Figure 6:
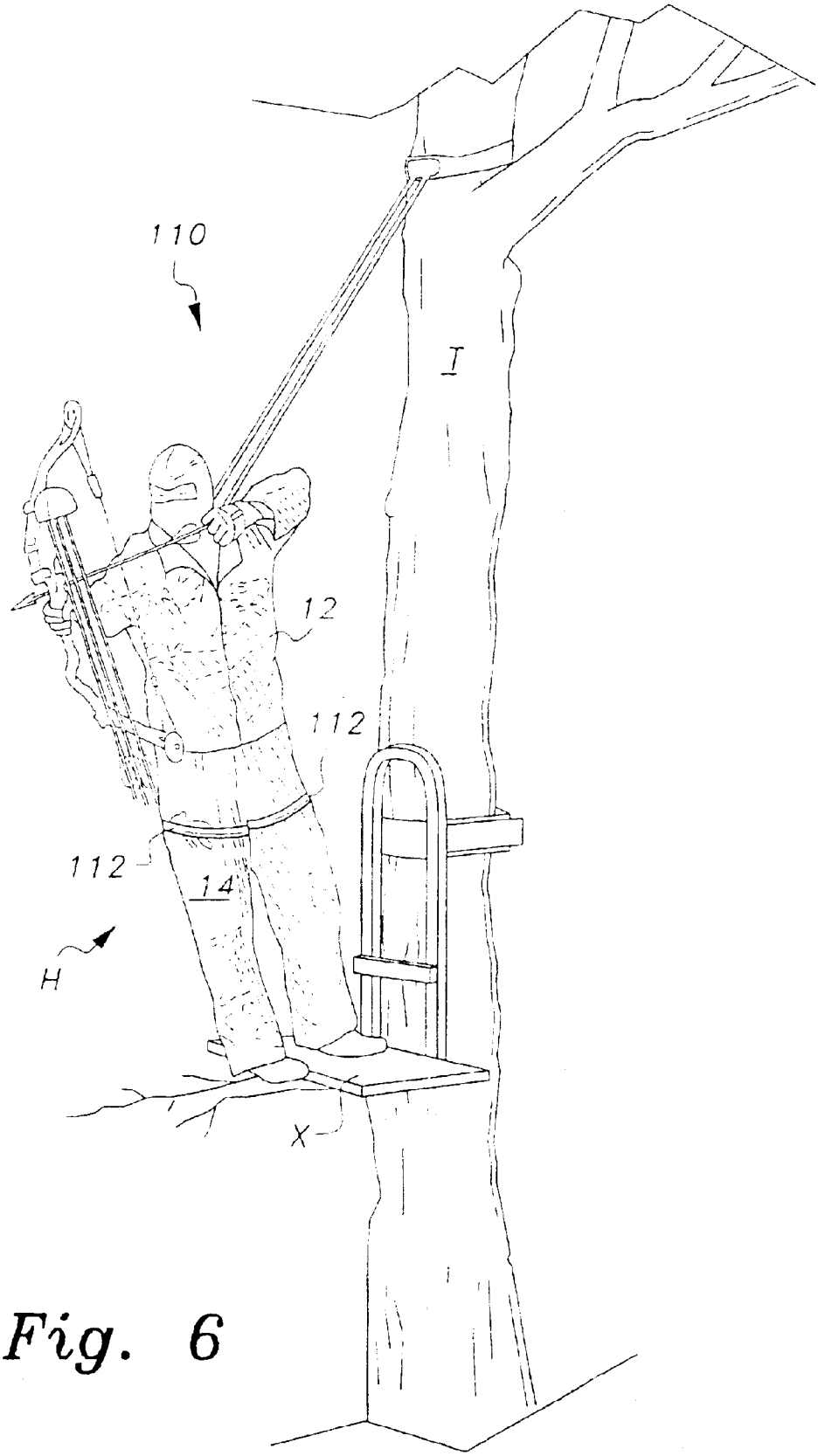
FIG. 6 is an environmental, perspective view of the safety garment employing removable leg loops, according to the present invention.

Referring to FIG. 6, there is shown an environmental perspective view of a two-piece safety garment with removable leg loops 110. Safety garment 110 comprises jacket 12 and separate pants 14, jacket 12 having leg loops assemblies 112 removably attached to the safety harness waist belt 16 (see FIG. 7A). Hunter H is suspended on tree T by platform X in a position to acquire game.

Figure 7A:
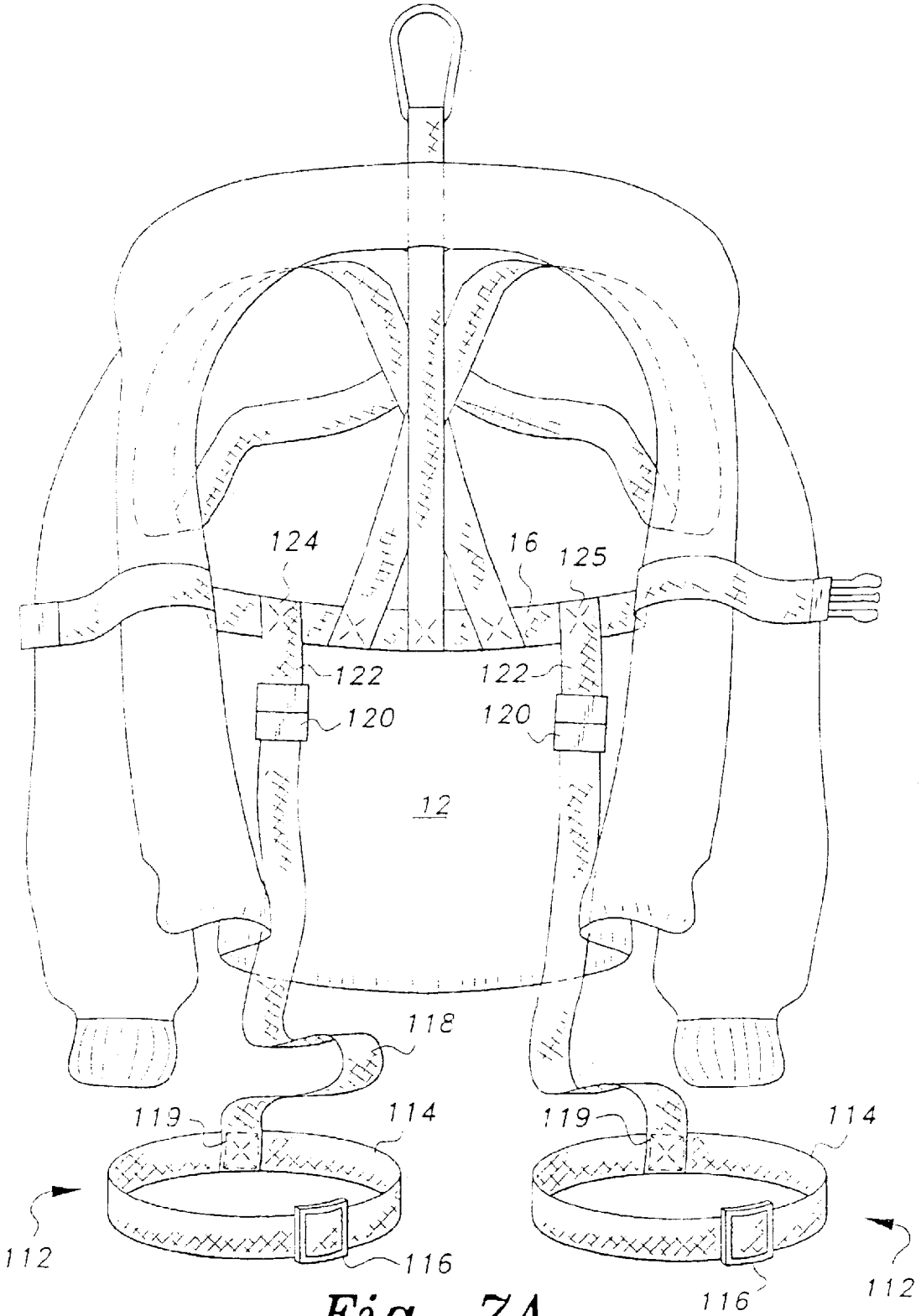
FIG. 7A is a front elevation view of a safety garment as above with the liner removed showing leg loops attached by buckles to the inner waist belt.
Figure 7B:
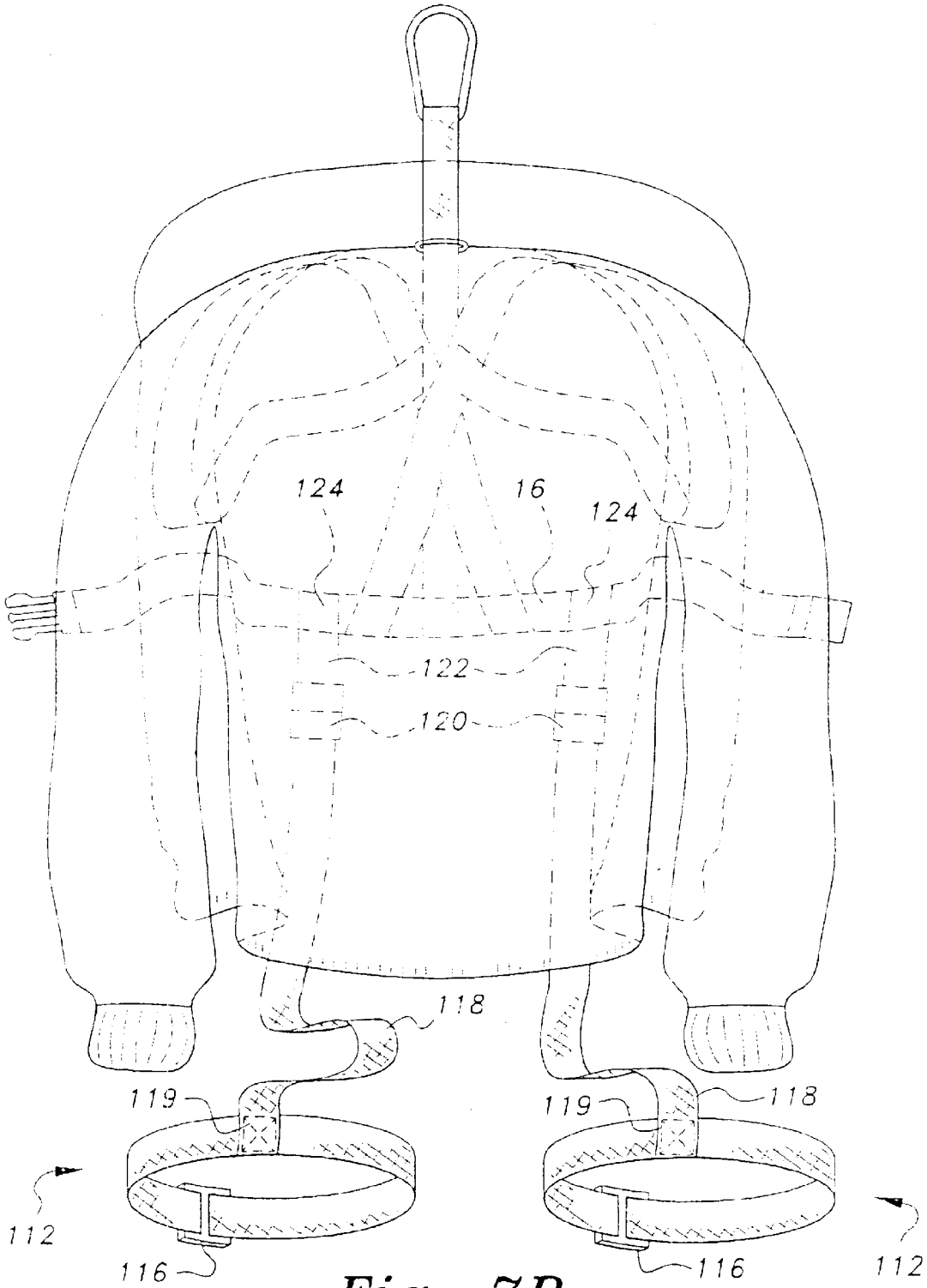
FIG. 7B is a rear elevation view of a safety garment as above with leg loops attached by buckles to the inner waist belt.

Referring to FIGS. 7A and 7B, there is shown a front elevation and a rear elevation view of safety garment jacket 12 without the liner and having inner disposed harness waist belt 16. Leg loop assemblies 112 each have leg loop portion 114 having adjustment buckles 116 and leg loop straps 118 attached as by sewing at attachment point 119. Leg loop attachment straps 118 are attached to waist belt 16 by means of attachment buckles 120 and waist strap attachment belts 122. Waist strap attachment belts 122 are attached as by sewing to waist belt 16 at attachment points 124 and 125. Leg loops 112, and waist strap attachment belt 122 are preferably of the same material and have the same width and thickness as waist belt 16. The leg loops may be worn either inside or outside trousers or even shorts in hot weather.

Figure 8:
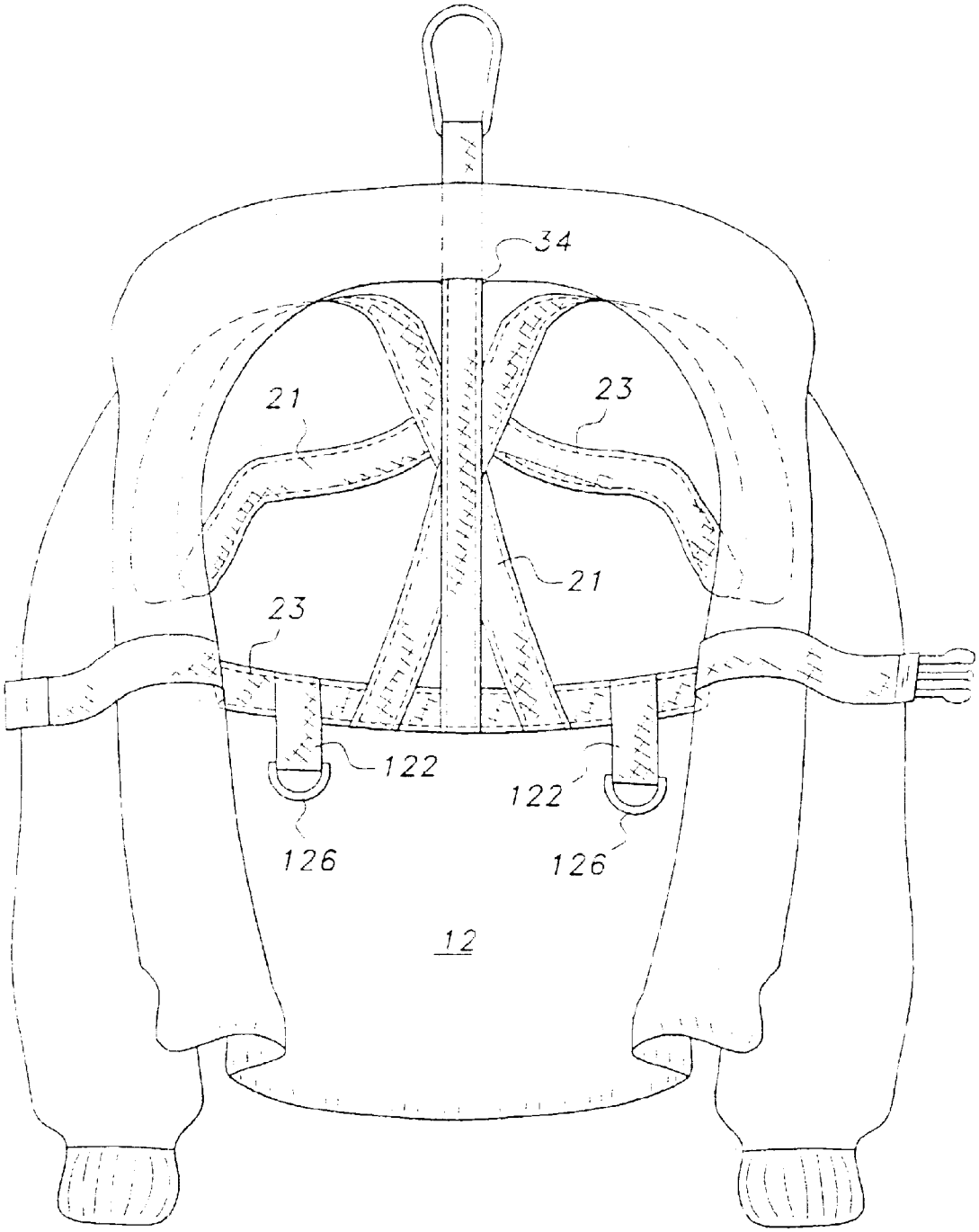
FIG. 8 is a front elevation view of a safety garment as above with the liner removed and the harness stitched to the outer shell and showing attachment rings for attachment of leg loops to the waist belt and for use with climbing rope.

Referring to FIG. 8, there is shown a front elevation view of a safety garment jacket as above with attachment rings 126 attached to waist belt 16 by means of waist strap attachment belts 122. It is noted that waist strap attachment belts 122 may be a sewn single layer strap, a free loop looping waist belt 16, or a sewn loop sewn in place as desired in all the embodiments described herein and may be moved along waist belt 16 to the sides in order to attach to safety pants described below.

Attachment rings 126 (shown as D-rings) or any equivalent attachment means disclosed herein may be attached to waist belt 16, waist strap attachment belts 122, or any other strap originating in the upper garment and attached to harness 20. A climbing strap of ordinary construction may be attached to attachment rings 26 by clips or other means to aid in climbing a tree or pole. One or more of the attachment rings 26 may be a relatively large ring for attaching a climbing strap. Also, stitching 23 is shown attaching the harness 20 to the inner surface of the outer shell of the safety jacket 12 as an alternative to stitching to the inner liner and may be employed in any of the embodiments described herein. Stitching to the outer shell may result in leaks during rainstorms and thus its use is preferred for interior work.

Figure 9A:
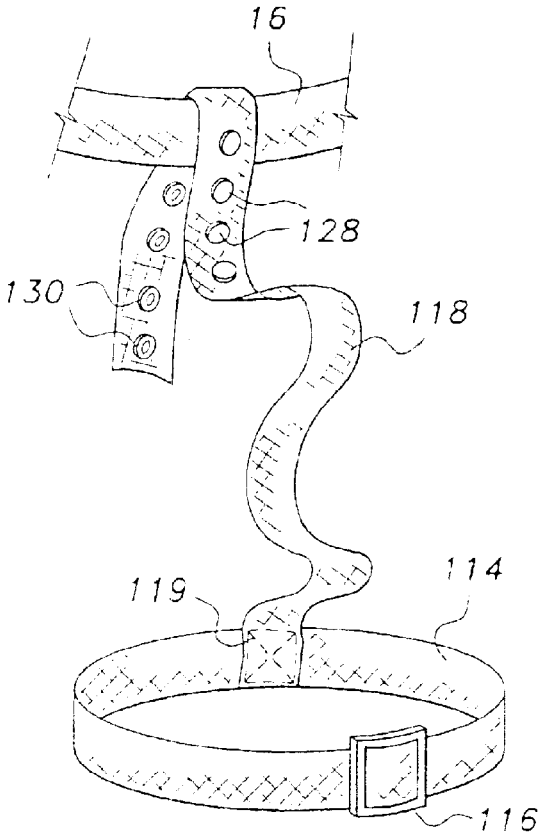
FIG. 9A is a detail view of a safety garment as above with snaps for attachment of leg loops to the waist belt.

Referring to FIG. 9A, there is shown a detail view of a hunting garment as above with leg loop strap 118 looped around waist belt 16 and secured by attachment snaps 128 secured by snap receivers 130 mounted on loop strap 118.

Figure 9B:
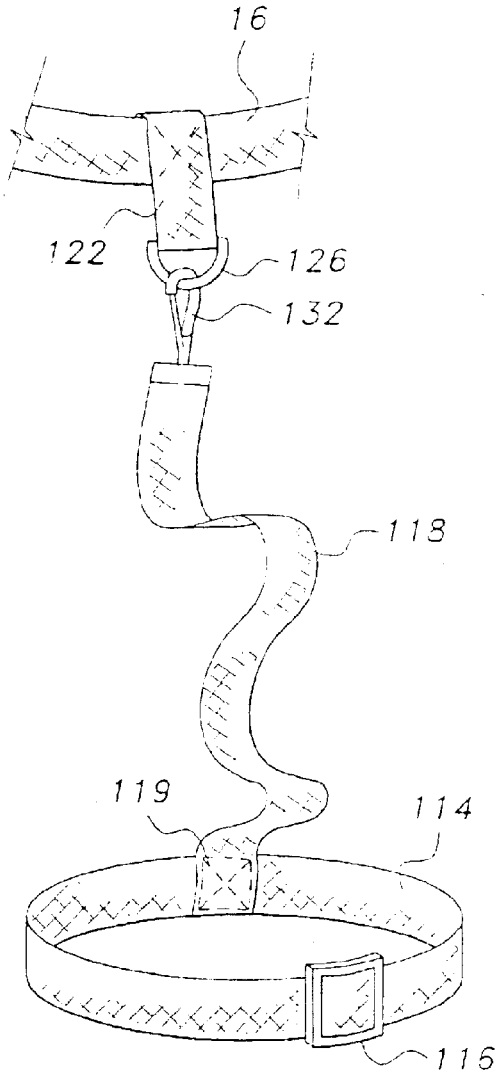
FIG. 9B is a detail view of a safety garment as above with an attachment ring and a snap hook for attachment of leg loops to the waist belt.

Referring to FIG. 9B, there is shown a detail view of a hunting garment as above with leg loop strap 118 having snap hook 132 for attachment to attachment ring 126.

Figure 9C:
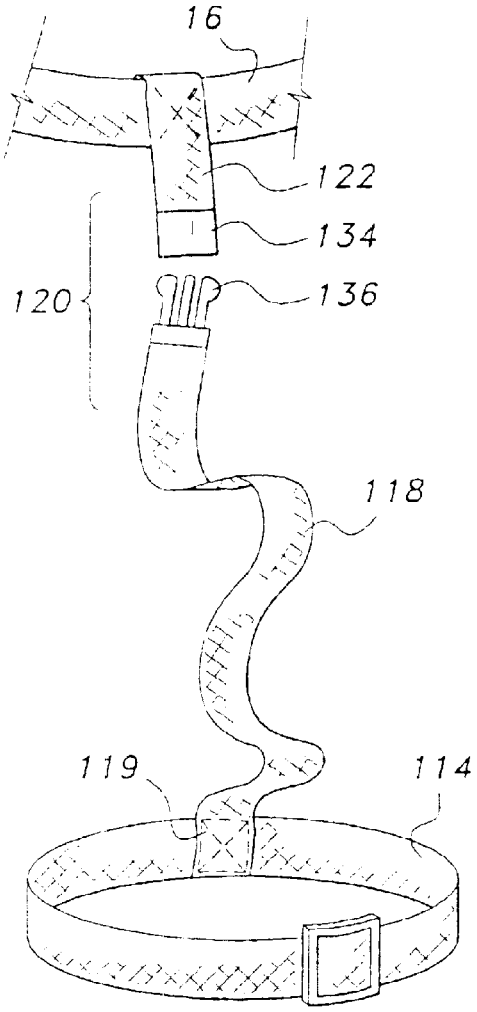
FIG. 9C is a detail view of a safety garment as above with an attachment buckle shown in an open position for attachment of leg loops to the waist belt.

Referring to FIG. 9C, there is shown a detail view of a hunting garment as above with leg loop strap 118 for attachment to waist belt 16 by means of buckle 120, buckle 120 being shown separated into leg loop-strap attachment buckle receiver 134 and leg loop-strap attachment buckle snap insert 136.

Figure 9D:
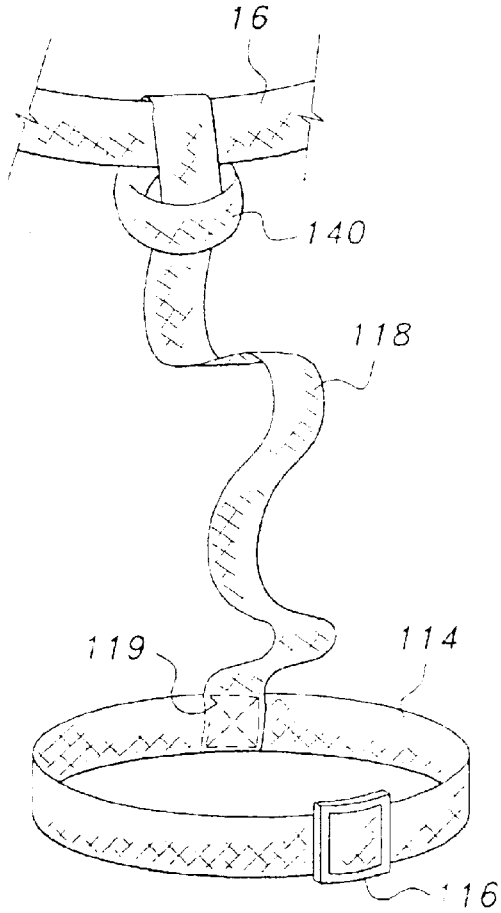
FIG. 9D is a detail view of a safety garment as above with a loop over knot for attachment of leg loops.

Referring to FIG. 9D, there is shown a detail view of a hunting garment as above with leg loop strap 118 looped over waist belt 16 with a loop-over knot 140. A loop is formed on the attachment end of leg loop strap 118 such as by sewing, which is of such size as to allow the entire leg loop assembly to be threaded through and around waist strap 118. Any other means of forming the loop is contemplated by the invention. The leg loop strap 118 may, alternatively, be knotted over the waist belt 16 such as by a cinch knot.

Figure 9E:
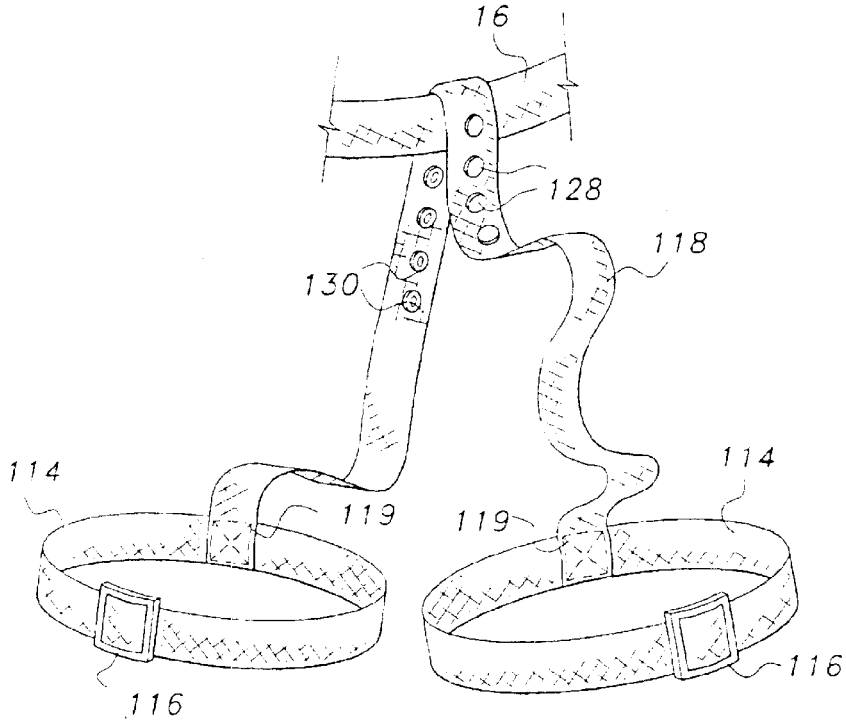
FIG. 9E is a detail view of a safety garment as above with a single strap supporting two leg loops.

Referring to FIG. 9E, there is shown a detail view of a hunting garment as above with two leg loop straps 118 formed by a single strap looped over waist belt 16 and secured by snaps 128 snapping into snap receivers 130. The single strap may be looped over waist belt 16 without securing snaps or other securing means if desired.

Figure 9F:
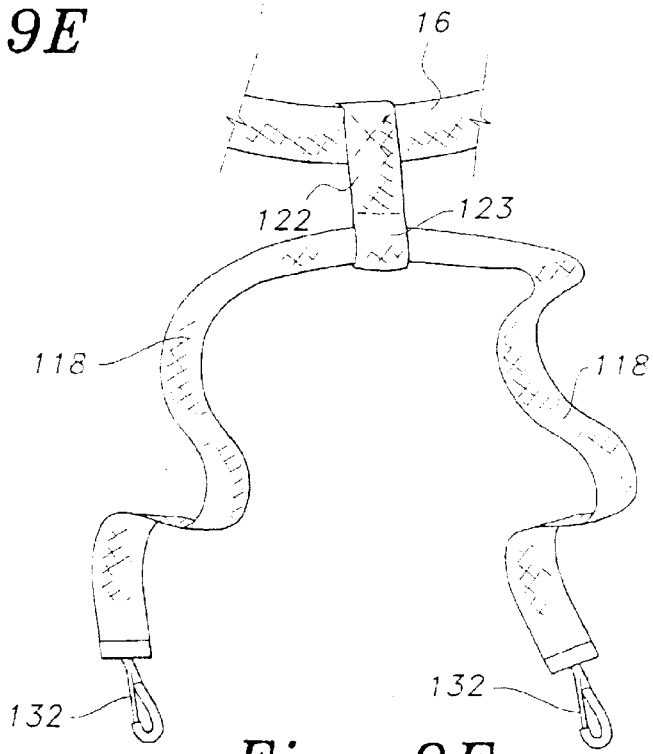
FIG. 9F is a detail view of a safety garment as above with a single strap supported by a looped strap and useful as crotch straps.

Referring to FIG. 9F, there is shown a detail view of a hunting garment as above having a single strap attachment belt 122, having an end loop 123 through which may be inserted a single strap serving as two crotch/leg straps 118. Snap hooks 132 may be attached at the remote ends for attachment to belt 16 by attachment belts 122 and attachment rings 126 (not shown). The remote ends of the single strap may be attached to belt 16 by any means such as a cinch knot.

Figure 9G:
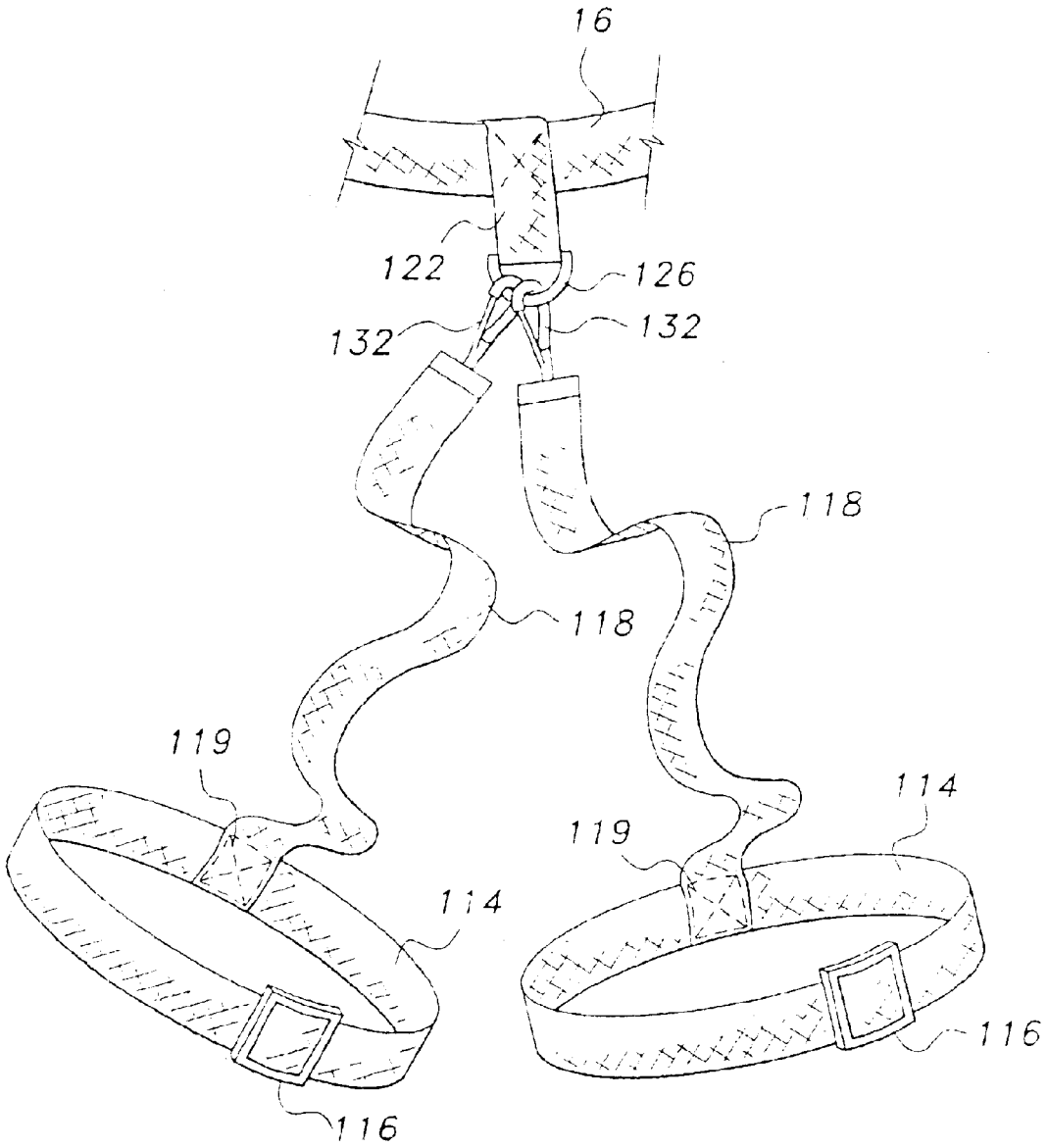
FIG. 9G is a detail view of a safety garment as above with two leg loop straps attached to a single support strap and ring.

Referring to FIG. 9G, a single attachment belt 122 having an attachment ring 126 is used to attach two leg loop straps 118 by means of snap hooks 132 to belt 16.

Figure 10:
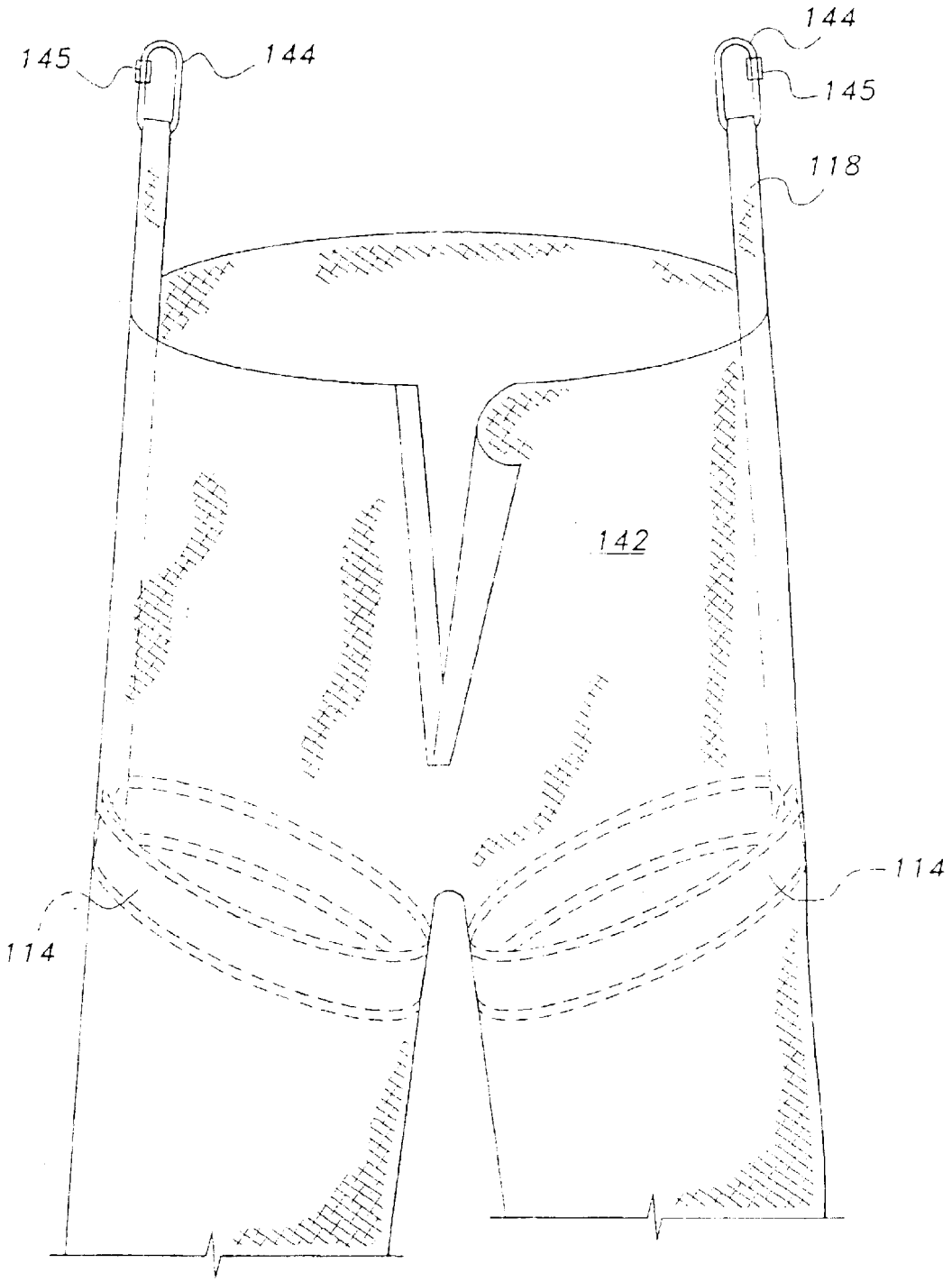
FIG. 10 is a perspective view of a safety pant with leg loops sewn within the interior of the pant and having threaded rings for attachment to the waist belt of the safety garment as above.

Referring to FIG. 10, there is shown a perspective view of a hunting pant 142 with leg loop portions 114 attached to the interior of the pant 142 as by sewing. Pant 142 is selectively reversible having a camouflage side and a bright colored side such as blaze orange in the manner of liner 24. Attachment threaded rings 144 having ring-securing collars 145 are shown for attachment of leg loop straps 118 to a hunting jacket such as previously described. Alternatives to sewing to secure leg loop portions 114 and leg loop straps 118 to the inner side of pant 142 includes hook and loop material (VELCRO), adhesive, and heat sealing, snaps, loops, etc., depending on materials used. A climbing strap of well-known design for climbing trees or poles may be attached to one or more of the attachment rings 144 as desired to assist the user in climbing to the desire perch or workplace.

Figure 11:
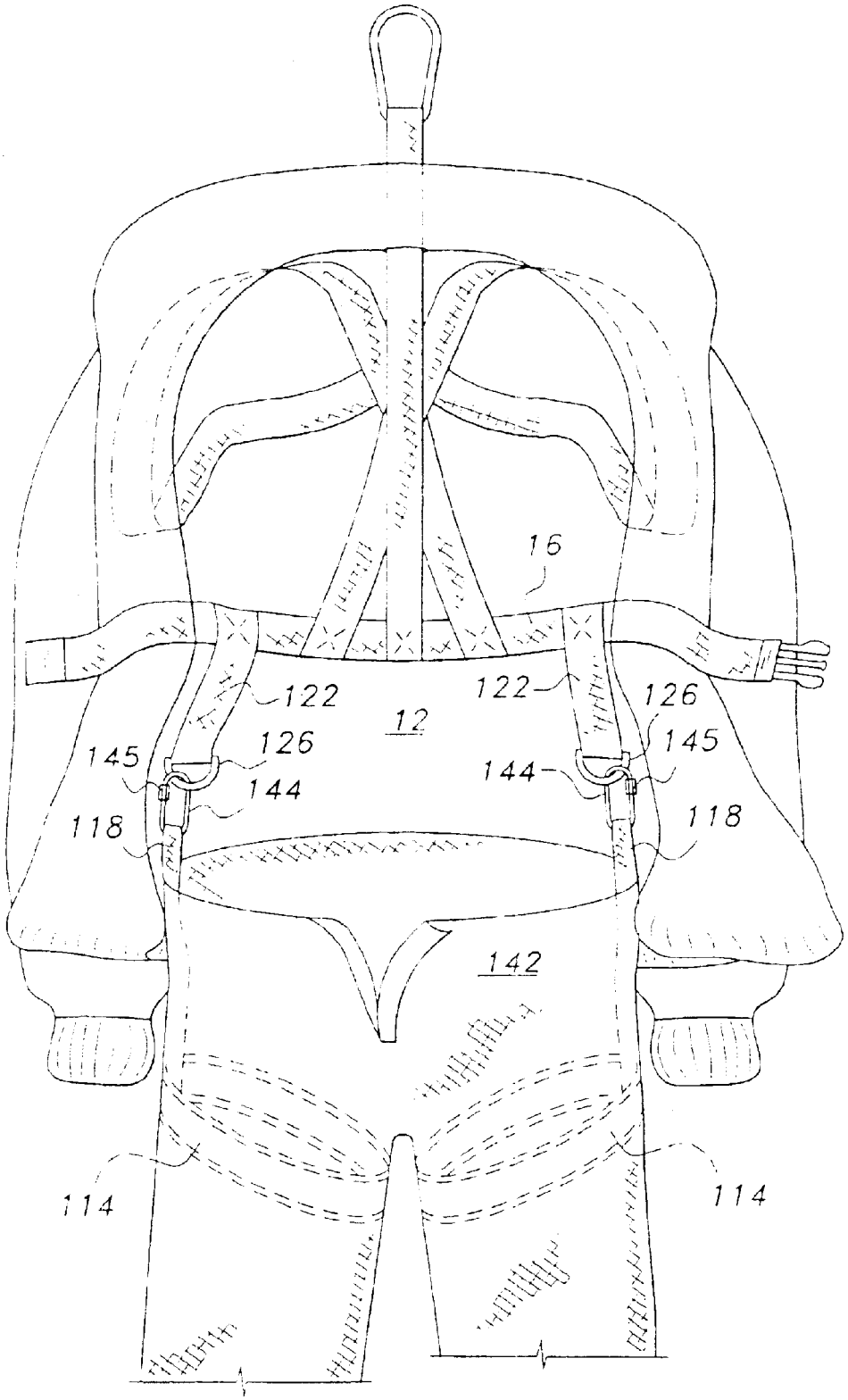
FIG. 11 is a front elevation view of the safety pant as above attached to attachment rings of the waist belt of the hunting garment with the liner removed as above.

Referring to FIG. 11, there is shown a front elevation view of the safety pant 142 as above attached to attachment rings 126 of waist belt 16 of the safety jacket 12.

Figure 12:
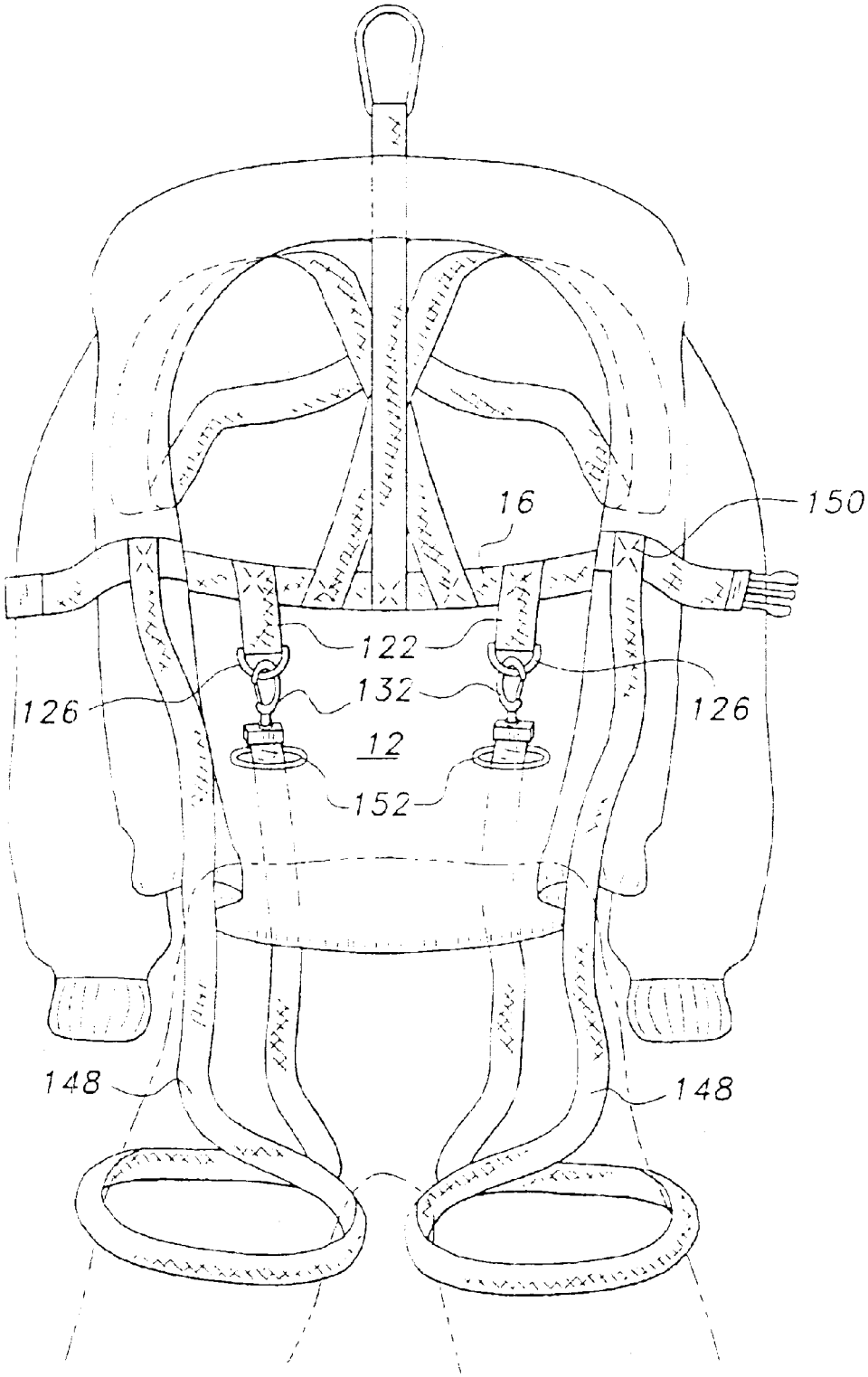
FIG. 12 is a front elevation view of a safety garment jacket with the liner removed for illustration purposes and showing crotch straps attachable at one end to the rear portion of the waist belt of said jacket through slits in the jacket back and at the other end to the front portion of the waist belt, spaced from the first attachment waist which may wrap around the legs or be tightened directly within the crotch.

Referring to FIG. 12, there is shown a front elevation view of the safety garment jacket 12 with crotch straps 148 acting as leg loop straps. A single or both crotch straps 148 are attachable at one end to the rear portion of the waist belt 16 through jacket through-holes 152 in the jacket back. Crotch straps 148 are shown attached at the other end at crotch strap belt attachment 150, the front portion of the waist belt spaced from the rear portion of the waist belt 16. The straps 148 may alternatively be removably attached at attachment 150 by any of the several attachment means discussed above. Crotch straps 148 may be wrapped around the wearer's respective legs to act as leg loop portions 114 or may be tightened directly within the crotch of the wearer. Crotch straps 148 may be of such length as to fit the user or may include adjustment buckles (not shown).

Figure 13:
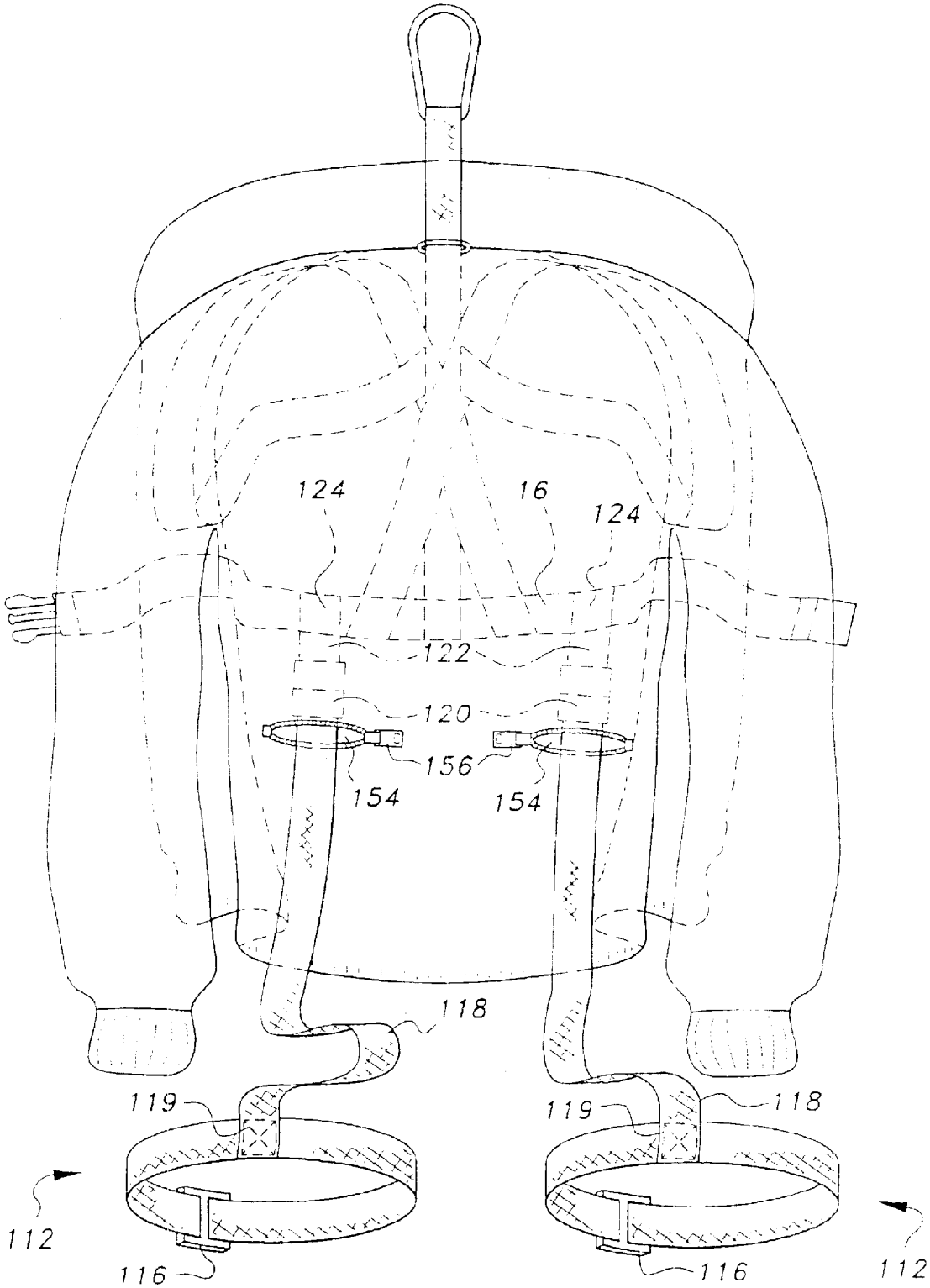
FIG. 13 is a rear elevation view similar to that of FIG. 12 with the safety jacket having the harness sewn between inner and outer layers and buckled leg straps inserted into zippered slits in the back outer layer for attachment to the waist strap inside the garment.

Referring to FIG. 13, there is shown a rear elevation view similar to that of FIG. 12 with the safety jacket 12 having the harness sewn between the inner lining and outer shell and buckled leg straps 118 inserted into slits 154 having zippers 156 in the back outer shell of jacket 12 for attachment to the waist strap inside the garment. Equivalent attachment means as described above may be substituted for buckles 120.

Figure 14:
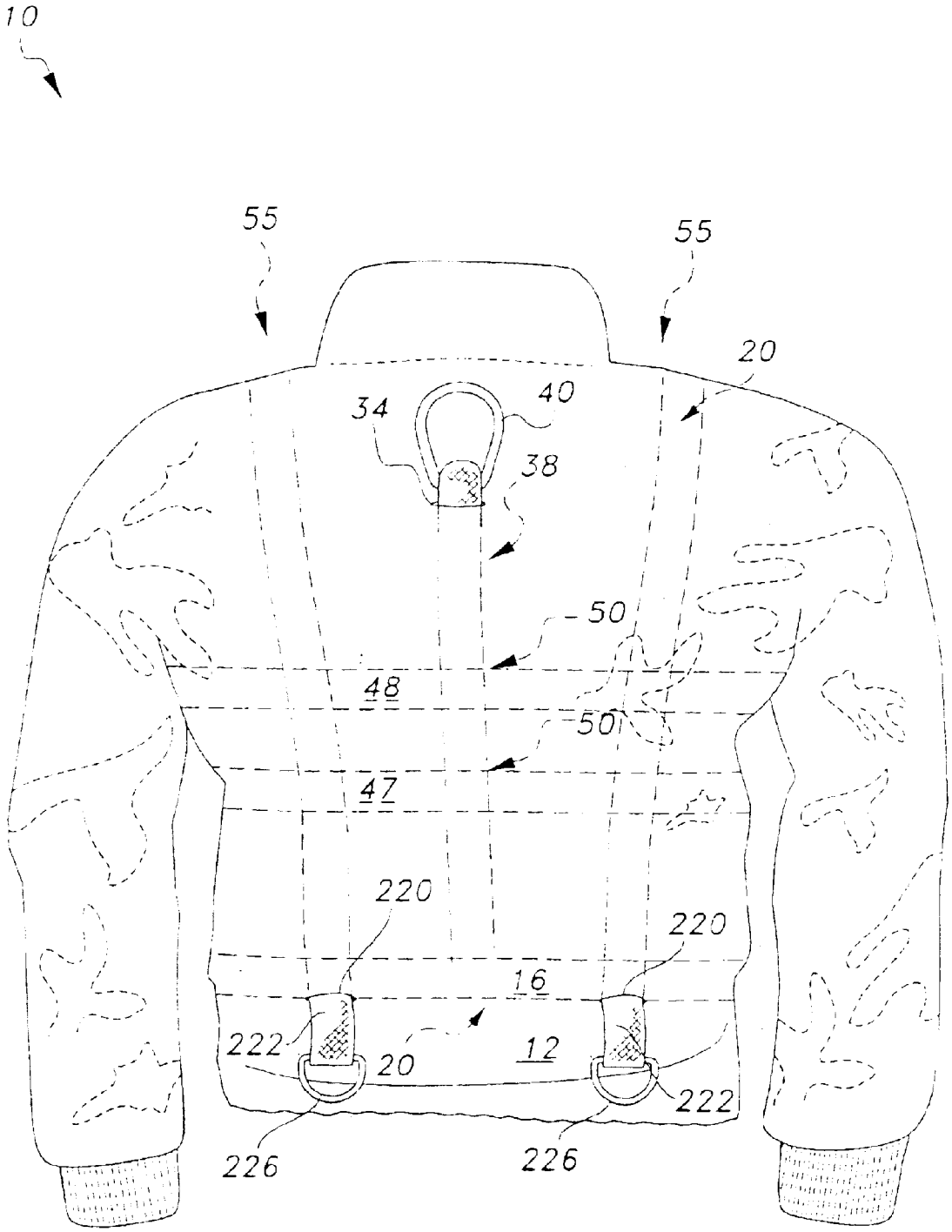
FIG. 14 is a rear elevation view similar to that of FIG. 5B having the shoulder straps extending from the waist belt through slits to support attachment rings for attachment of accessories.

Referring to FIG. 14, there is shown an embodiment of the inventive safety jacket similar to that as shown in FIG. 5B having extensions 222 of shoulder straps 55 extending out through slits 220 at waist belt 16, extensions 222 having attachment rings 226 for attachment of removable crotch/leg straps, fanny packs, or tethers for dragging game. Extensions 222 may be pulled through slits 220 if it is desired that the attachment rings be carried on the inner side of the jacket.

Figure 15:
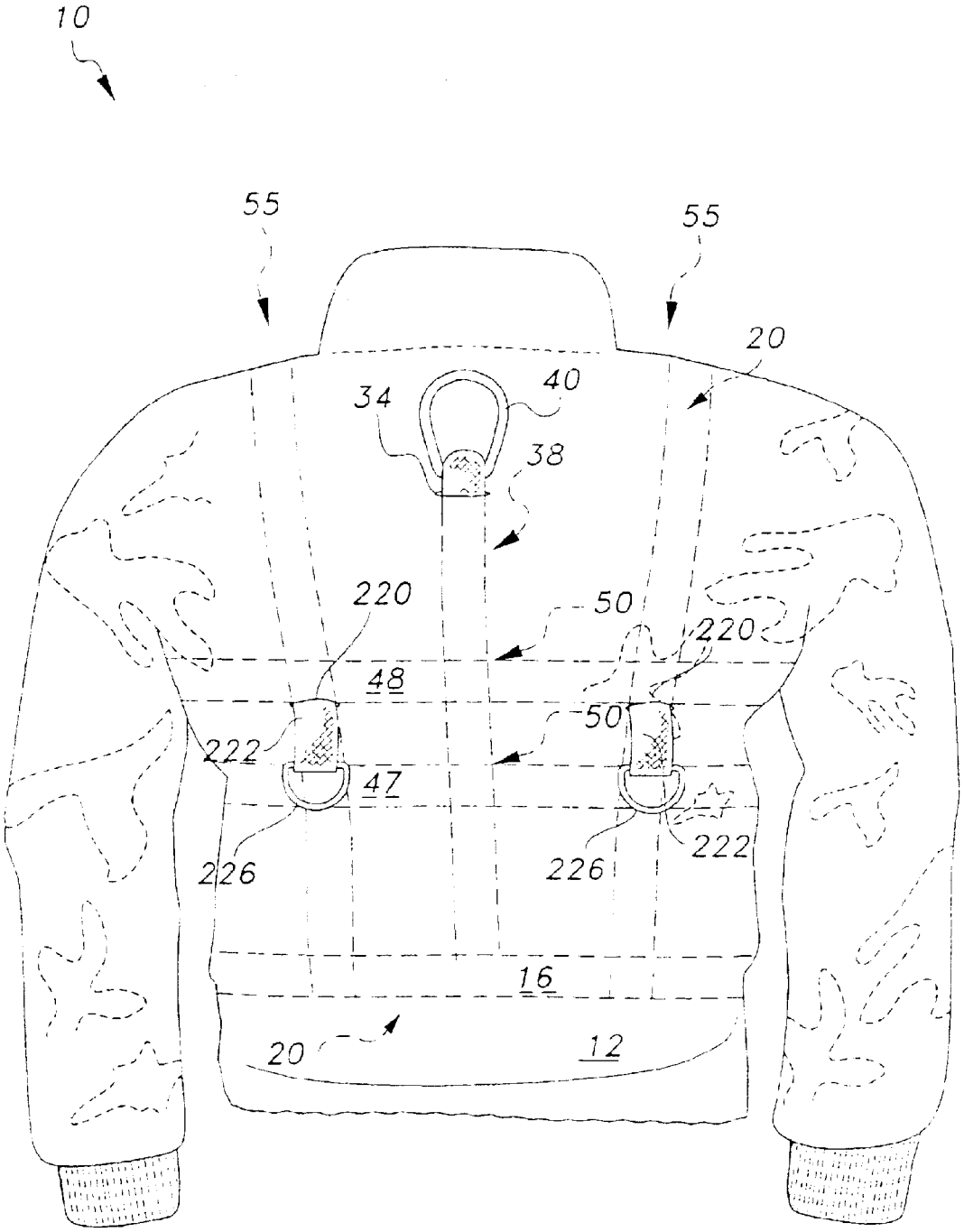
FIG. 15 is a rear elevation view similar to that of FIG. 14 having attachment straps extending from an upper torso or chest belt through slits for attachment of accessories.

Referring to FIG. 15, there is shown an embodiment of the inventive safety jacket similar to that as shown in FIG. 5B, having extensions 222 attached to shoulder straps 55 at cross straps 48, extending through slits 220 and supporting attachment rings 226. Attachment rings 222 are useful for attaching a backpack (not shown) or additional tether lines as desired for added safety.

Figure 16:
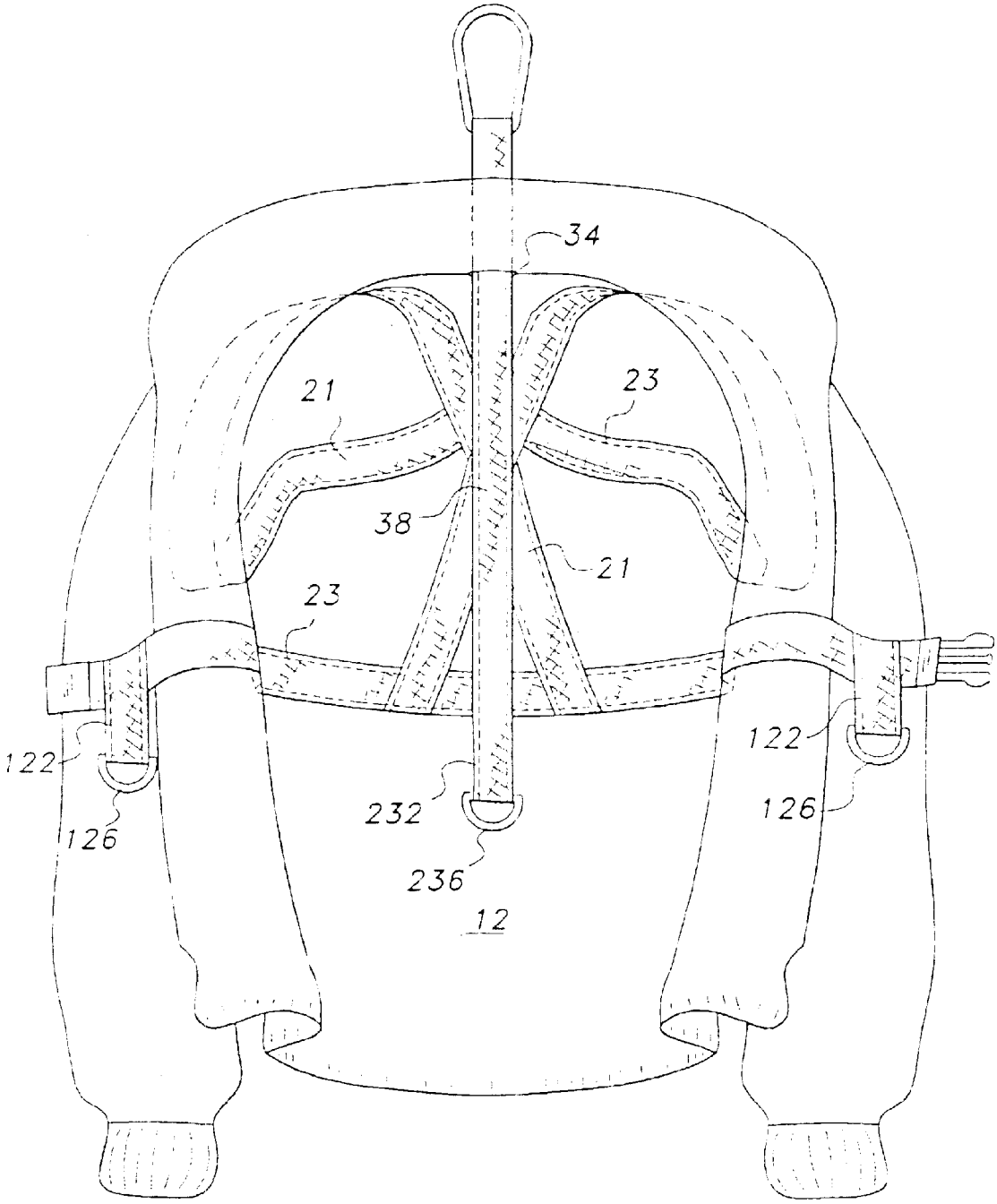
FIG. 16 is a front elevation view similar to that of FIG. 8, the safety strap having an extension and attachment ring below the waist belt and having an attachment belt and ring attached near each end of the waist belt for supporting crotch/leg straps.

Referring to FIG. 16, there is shown an embodiment of the inventive safety jacket similar to that as shown in FIG. 8, having a lower extension 232 of safety strap 38 having an attachment ring 236 at its lower end, and attachment straps 122 attached to waist belt 16 near each part of buckle 18. This arrangement is useful for attaching "Y"-shaped crotch straps 260 (see FIG. 24B).

Figure 17:
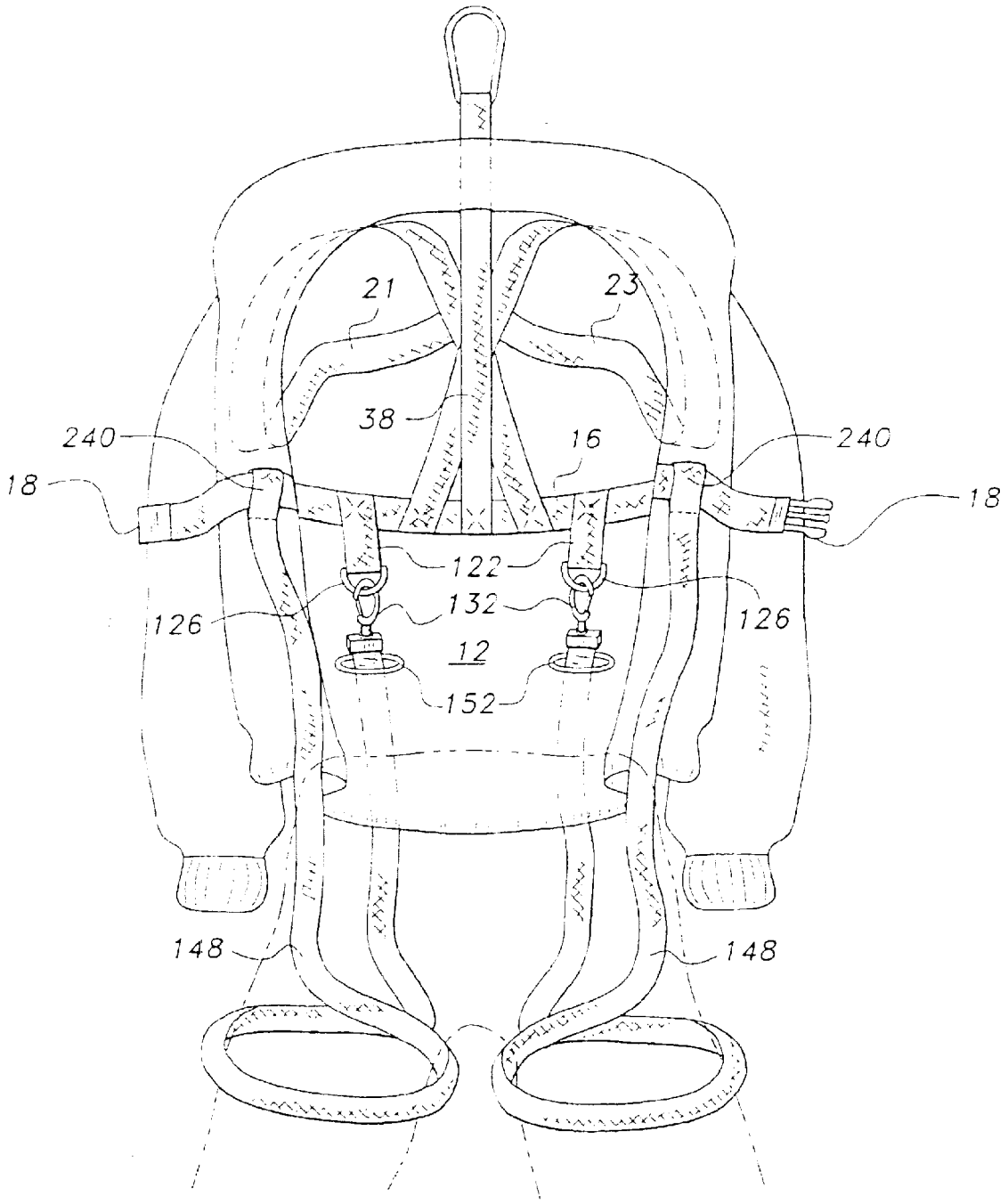
FIG. 17 is a front elevation view similar to that of FIG. 12, where crotch/leg straps have end loops which removably slide over the mating parts of the waist belt buckles.

Referring to FIG. 17, there is shown another embodiment of the inventive safety jacket similar to that as shown in FIG. 12, wherein crotch straps 148 are removably attached to waist belt 16 by sliding end loops 240 over buckle portions 18.

Figure 18:
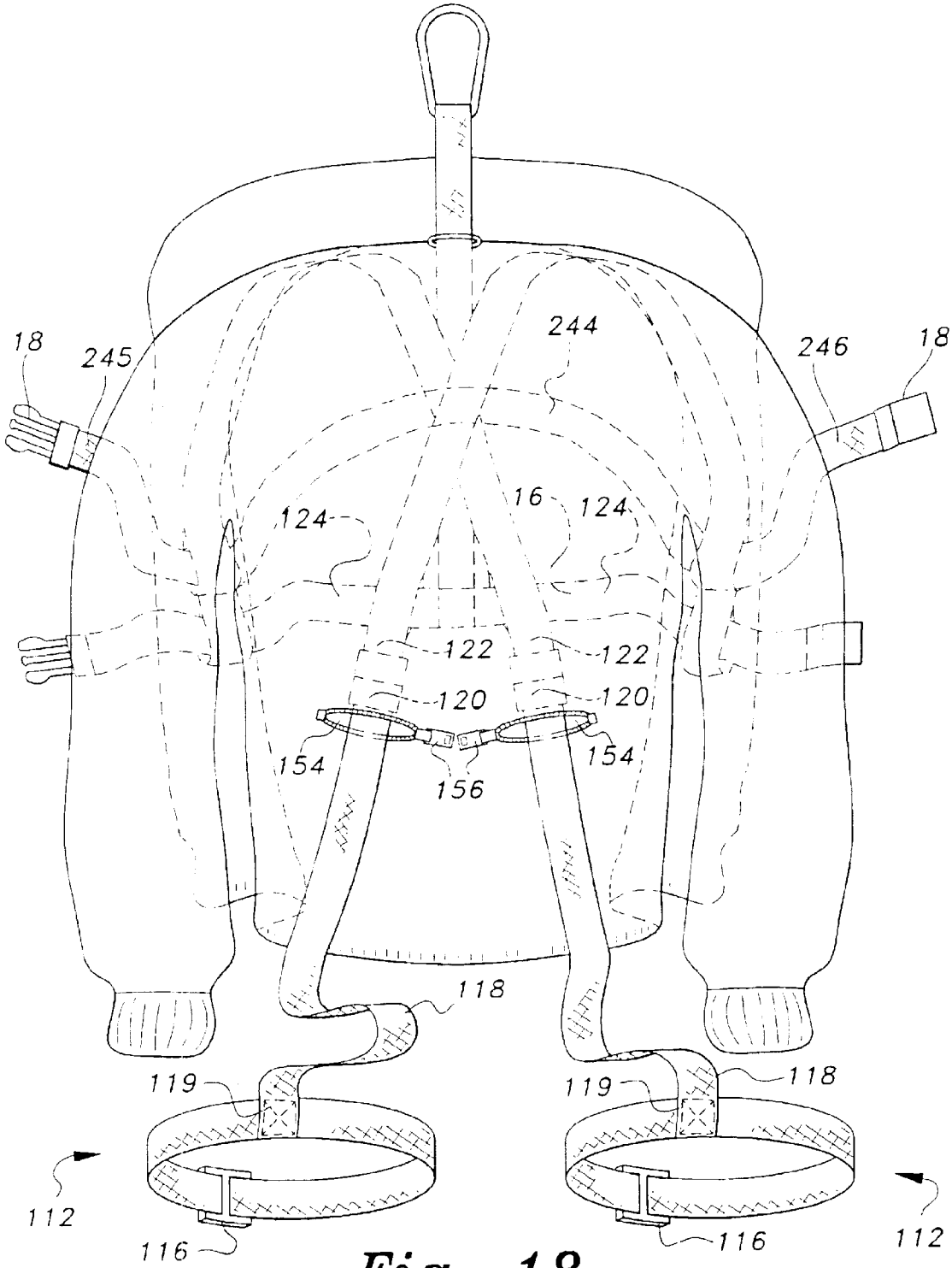
FIG. 18 is a rear elevation view similar that of FIG. 13, where leg loops are buckled to extensions of the crossed shoulder strap below the waist belt, and a single belt forms the shoulder straps from which upper torso straps extend for buckling across the chest.

Referring to FIG. 18, there is shown another embodiment of the inventive safety jacket similar to that as shown in FIG. 13, wherein shoulder straps 21 and 22 have direct extensions 122 connecting with leg straps 118 by means of buckles 120. As shown, leg loop straps 118 extend through openings 154 in the rear of the jacket to connect with attachment extensions 122 by means of buckles 120. Openings 154 have zippers 156 for closure when leg loops are not used. When the leg loop straps 118 are not used, zippers 156 may be used to close slits 154. Shoulder straps 21 and 22 also have upper torso extensions 245 and 246 having buckle portions 18 for securing around the wearer's chest.

Figure 19:
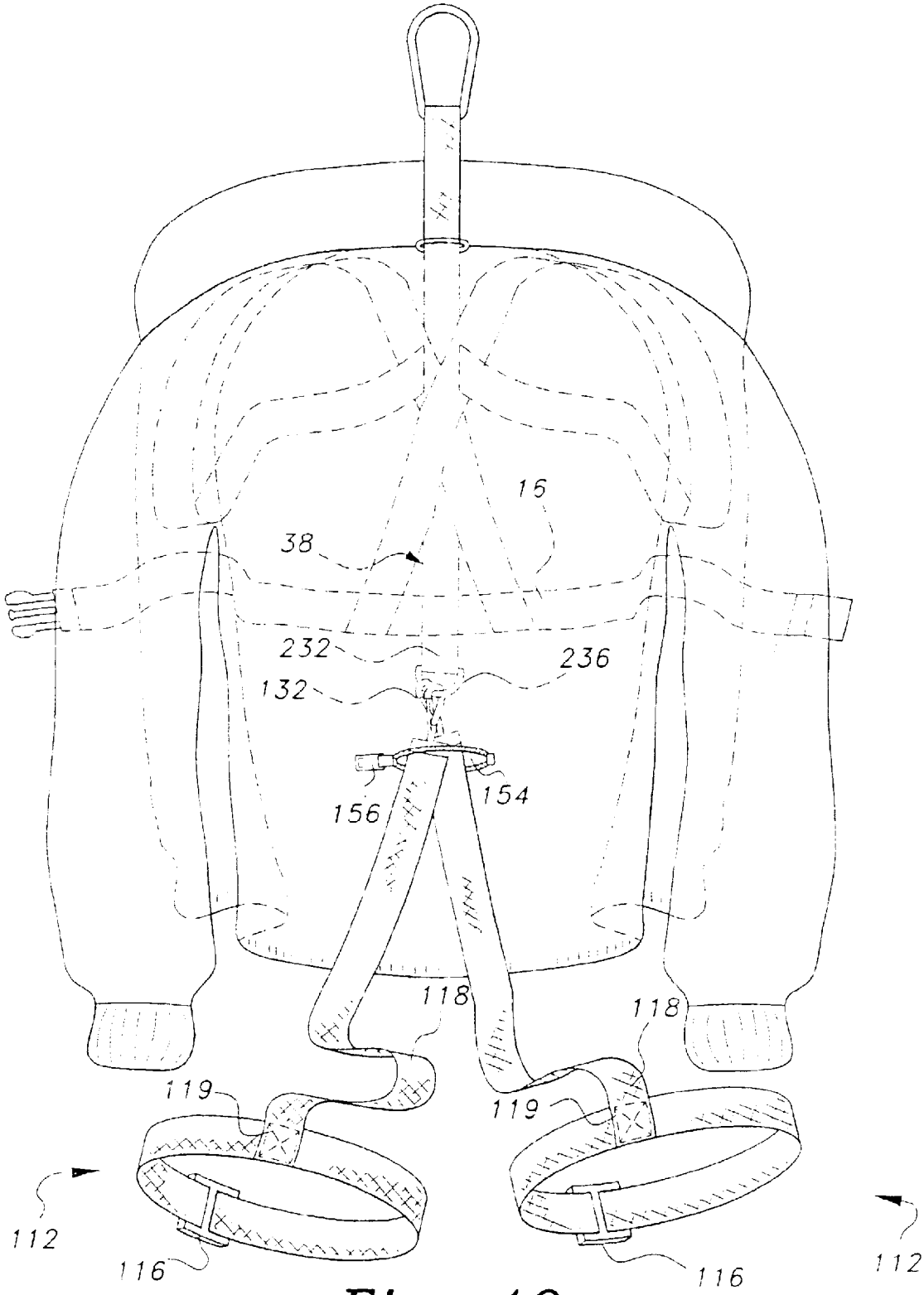
FIG. 19 is a rear elevation view similar to that of FIG. 13, where crotch/leg straps extend through a single back opening and are hooked to a lower extension of the safety strap having an attachment ring by snap hooks.

Referring to FIG. 19, there is shown another embodiment of the inventive safety jacket similar to that as shown in FIG. 13, wherein a lower safety strap extension 232 has a lower attachment ring 26 to which both leg straps 118 are removably attached by snap hooks 132, connected through a single slit 154 in the rear of the jacket having zippers 156. When the leg loop straps 118 are not used, zippers 156 may be used to close slits 154.

Figure 20:
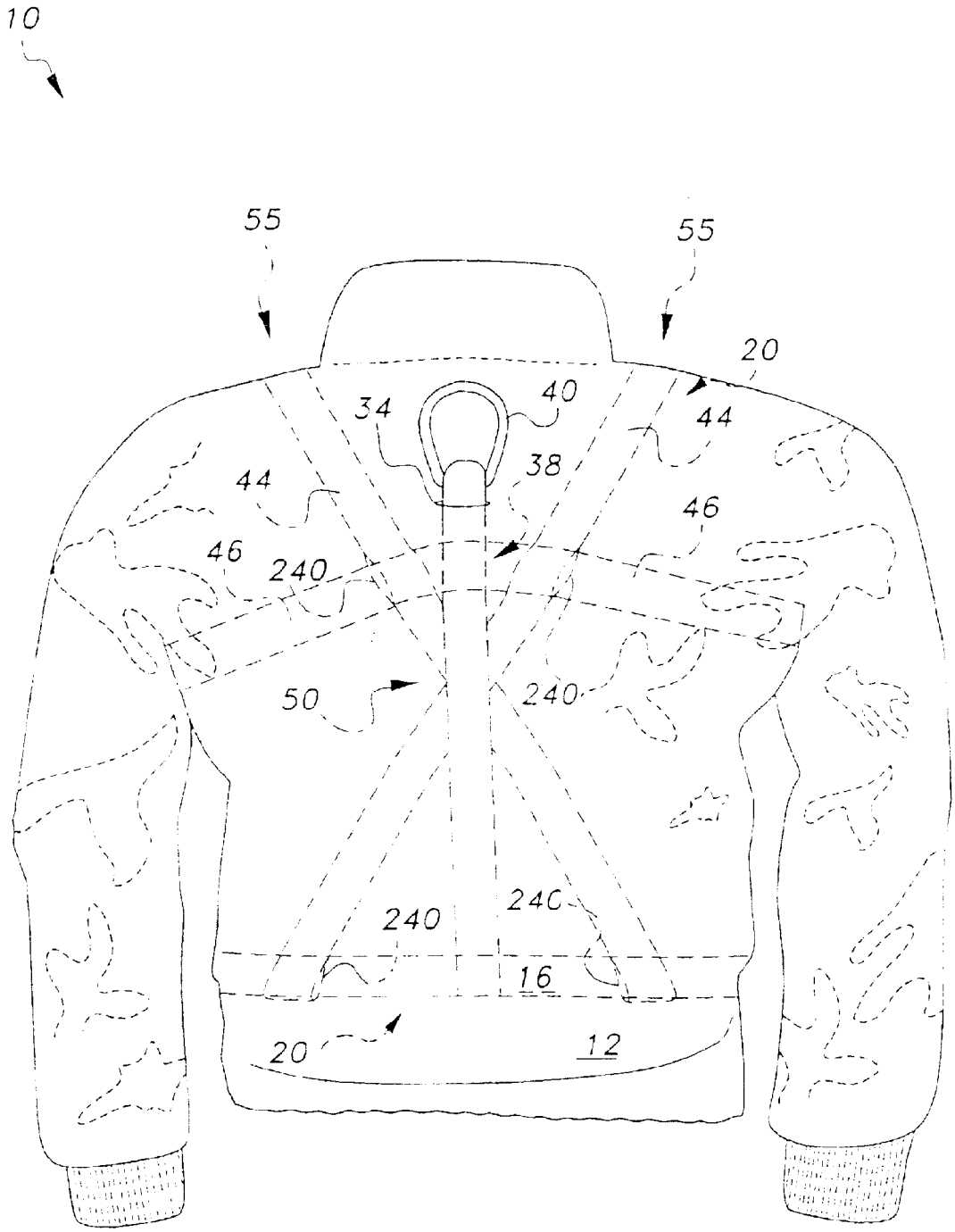
FIG. 20 is a rear elevation view similar to that of FIG. 5A where a single underarm strap is inserted through loops in shoulder straps to allow relative adjustment.

Referring to FIG. 20, there is shown another embodiment of the inventive safety jacket similar to that as shown in FIG. 5, wherein underarm straps 46 form a single strap extending across the back. Strap 46 may be inserted through loops 240 in shoulder straps 55 to allow adjustability. Also, shoulder straps 55 may have loops 240 through which waist belt 16 may be inserted for adjustability. Adjustability may be provided in the various embodiments of the harness 20 of the present invention by providing loops instead of sewing or other permanent attachment.

Figure 21:
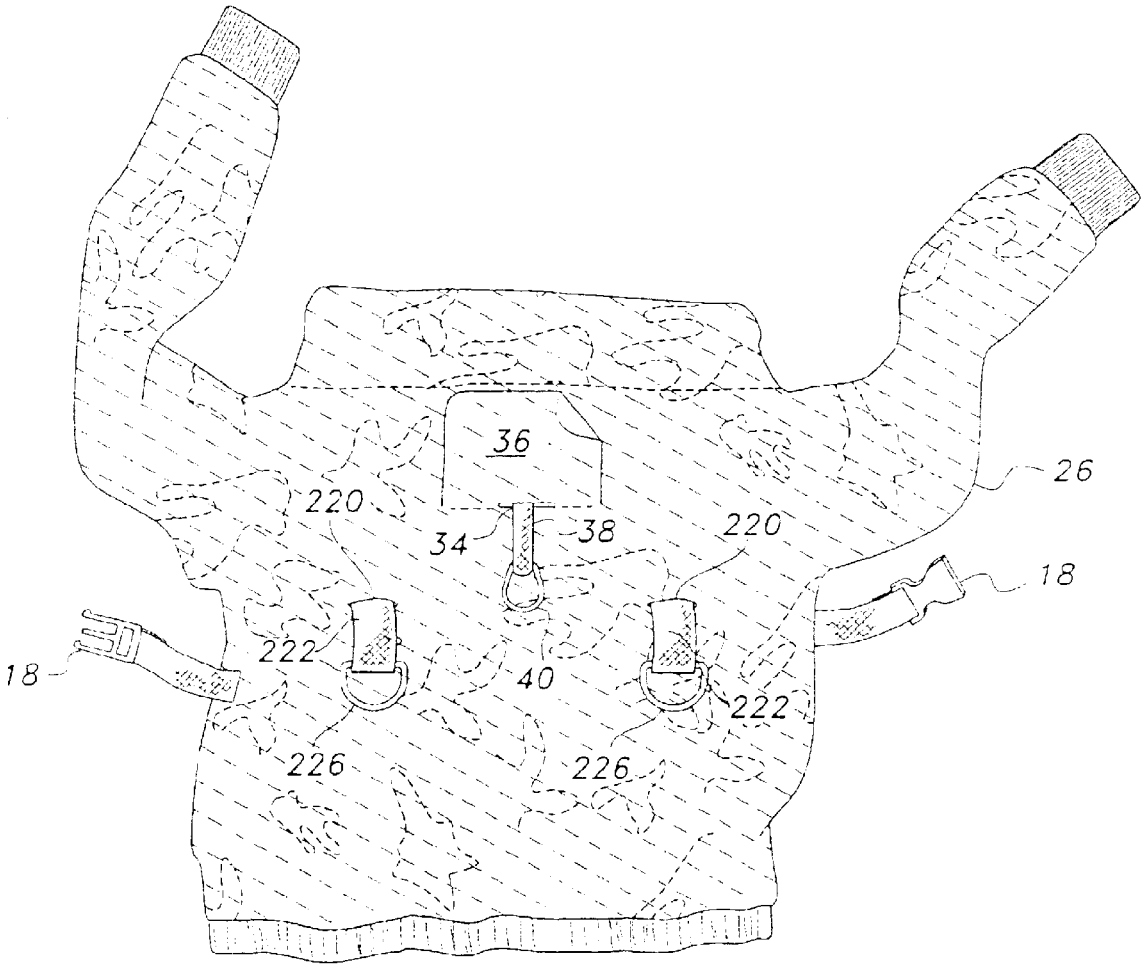
FIG. 21 is a rear elevation view similar to that of FIG. 3 with attachment straps extending from the shoulder straps of the harness through the back of the jacket having support rings for attaching a backpack.

Referring to FIG. 21, there is shown another embodiment of the inventive safety jacket similar to that as shown in FIG. 3, wherein attachment straps 222 extend through slits 220 and are attached to the harness 20 (see FIG. 2A) such as at waist belt 16 or shoulder straps 21 and 22, the attachment straps 222 supporting attachment rings 226. The attachment rings 226 are useful for attaching a back pack or additional support lines.

Figure 22:
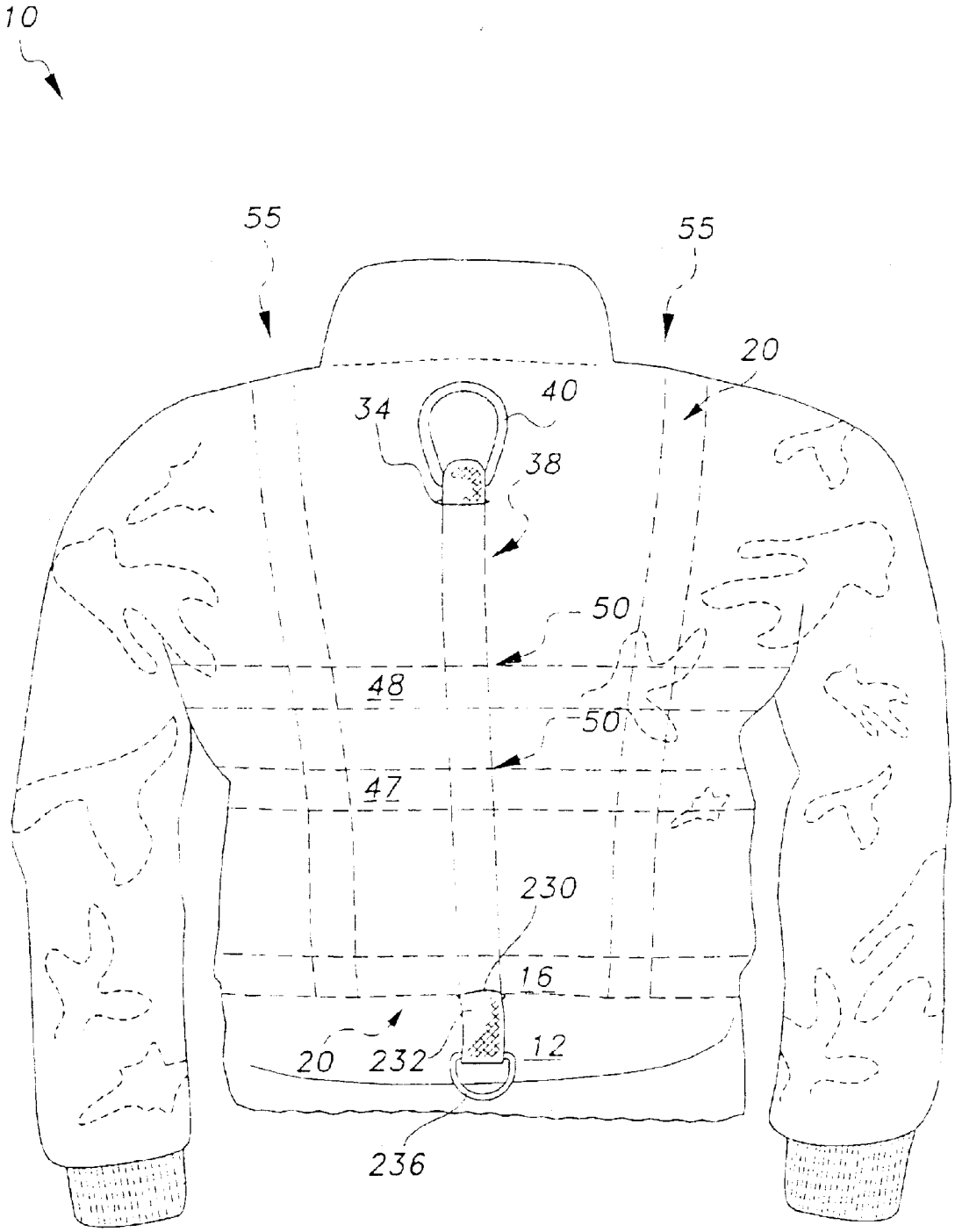
FIG. 22 is a rear elevation view similar to that of FIG. 5B having an extension of the safety strap extend below the waist belt through a slit in the back of the jacket having a support ring for a crotch/leg straps or deer drag.

Referring to FIG. 22, there is shown another embodiment of the inventive safety jacket similar to that as shown in FIG. 5B, wherein safety strap extension 232 extends through slit 130 and supports lower attachment ring 236 for attachment of leg loop straps or crotch straps or a fanny pack or the like. Ring 236 may also be useful for attachment of a drag line for deer or other game or a sled, etc.

Figure 23A:
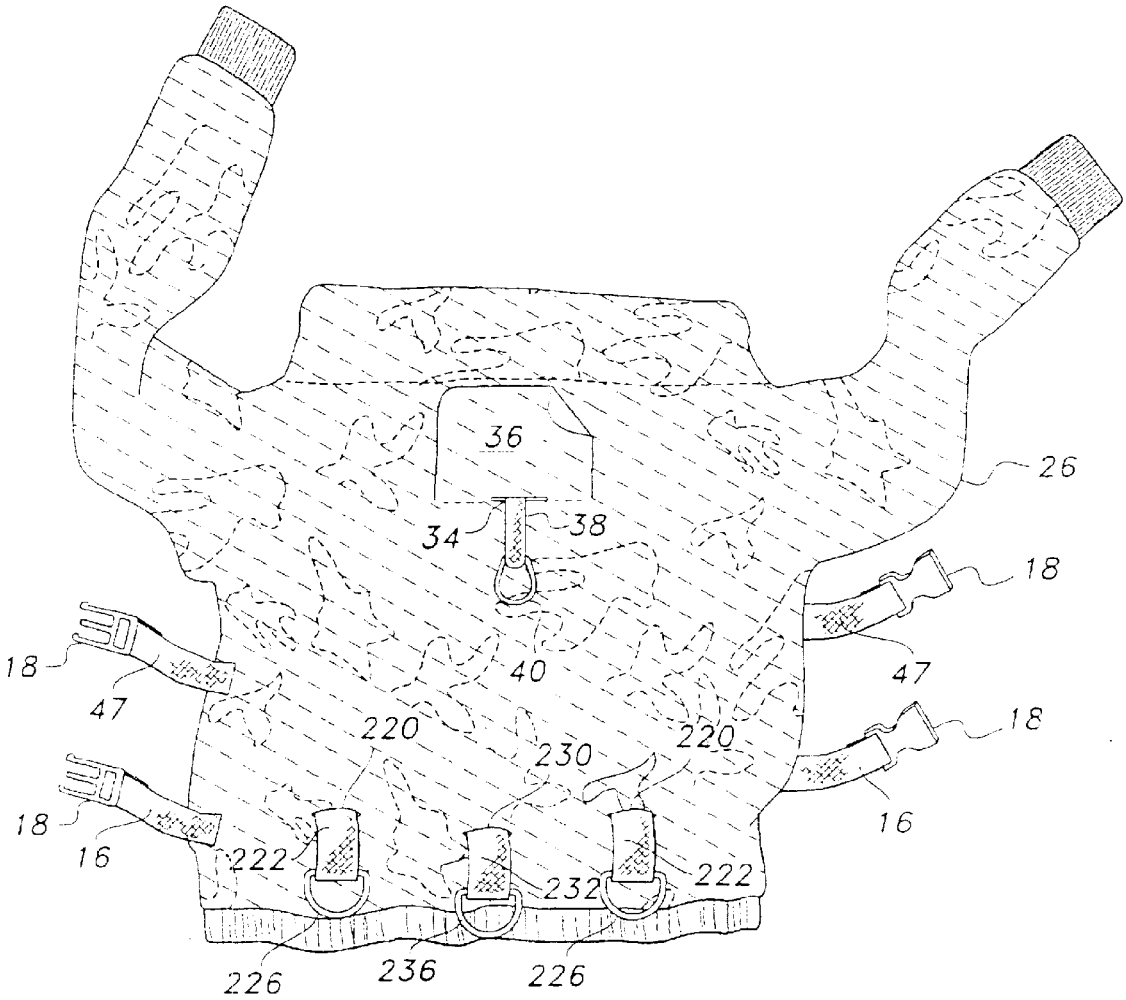
FIG. 23A is a rear elevation view similar to that of FIG. 22 having side attachment straps which are extensions of the shoulder straps and a center attachment strap extension of the safety strap, each extending below the waist belt through back slits for attachment of fanny pack and crotch/leg straps or deer drag from respective rings.
Figure 23B:
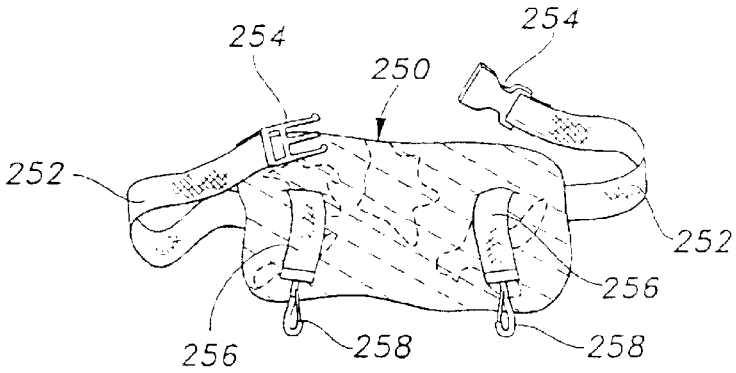
FIG. 23B is an elevation view of a fanny pack useful with the attachment straps of FIG. 23A.

Referring to FIGS. 23A and 23B, there is shown another embodiment of the inventive safety jacket similar to that as shown in FIG. 3 wherein side attachment straps 222 are attached to harness 20 such as belt 16 and extend through lower slits 220 and support attachment rings 226 for attachment of fanny pack 250 as shown in FIG. 23B. Safety strap 38 has an extension 232 extending through slit 230 for supporting attachment ring 236 which is useful for attachment of a drag line for deer or other game. Extension 232 may be attached and exit a slit 230 from a higher position on the back of the safety jacket along safety strap 38 as desired. A chest strap may also be provided as shown as part of the harness 20.

Referring to FIG. 23B there is shown a fanny pack having waist straps 252 with buckles 254 for wrapping around the waist of a hunter or worker. Added support to the fanny pack is provided by support straps 256 extending from pack 250 which have snap hooks 258 or the like for attachment to support ring 226 of the inventive jacket. This keeps the fanny pack 250 from sliding down over the hips without buckling waist straps 252 so tight as to become uncomfortable.

Figure 24A:
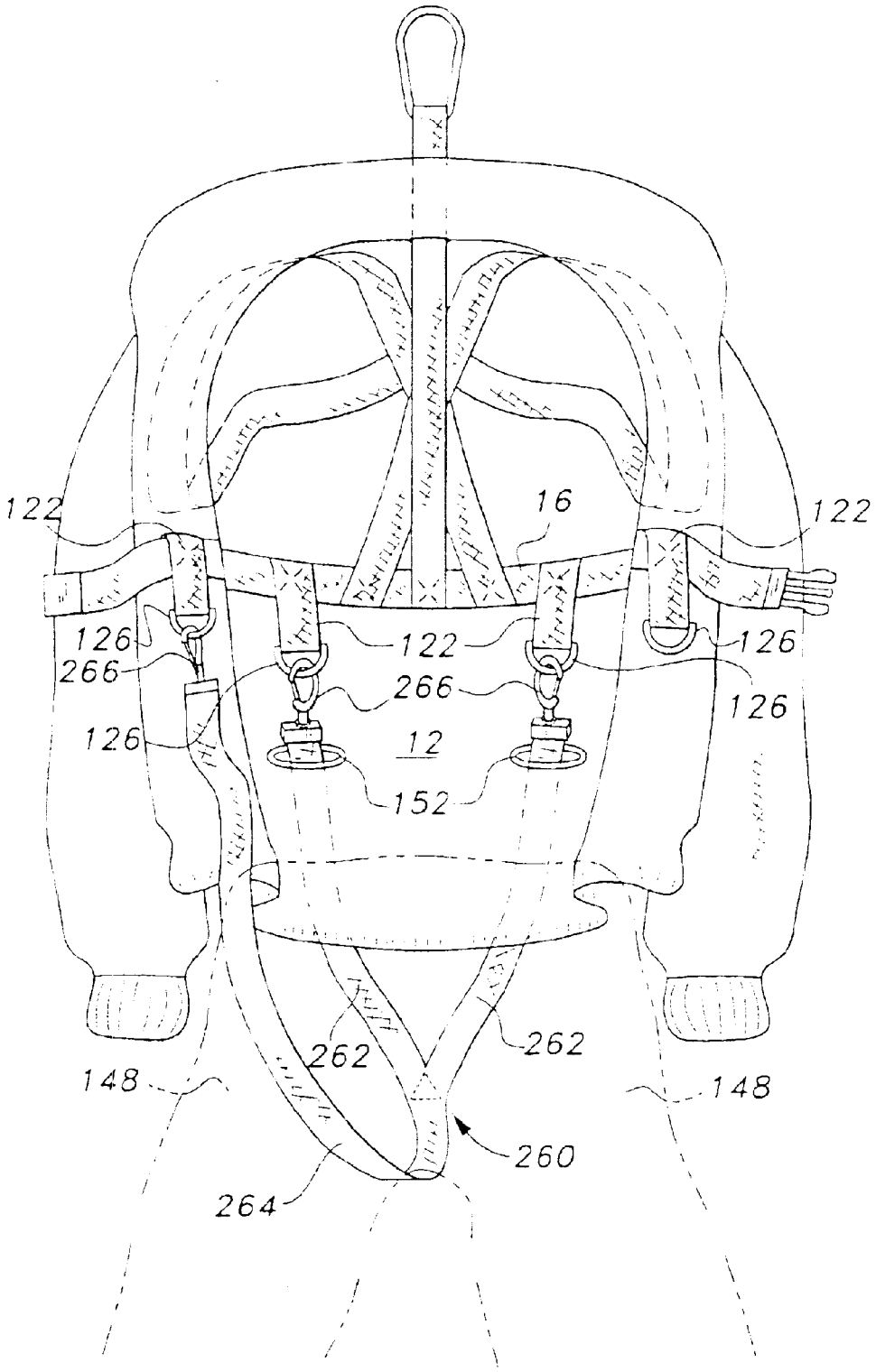
FIG. 24A is a front elevation view similar to that of FIG. 17 having a "Y"-shaped crotch strap having rear straps attached to rear support rings and a single crotch strap attached to a front mounted attachment strap ring.

Referring to FIG. 24A, there is shown another embodiment of the inventive safety jacket similar to that as shown in FIG. 17 having a "Y"-shaped crotch strap 260 having single strap 264 attached at the "Y" to two straps 262. A pair of attachment straps 122 is spaced along waist strap 16 in its rear portion to support attachment rings 126. Safety strap extension straps 262 extend through through-holes 152 in the jacket liner and are attached to respective attachment rings 126. Single strap 264 is attached to belt 16 by means of an attachment strap 122 attached inside the front of the jacket to belt 16 supporting attachment ring 126 (two shown), single strap 264 being attached to attachment ring 126 by means of a snap hook 266.

Figure 24B:
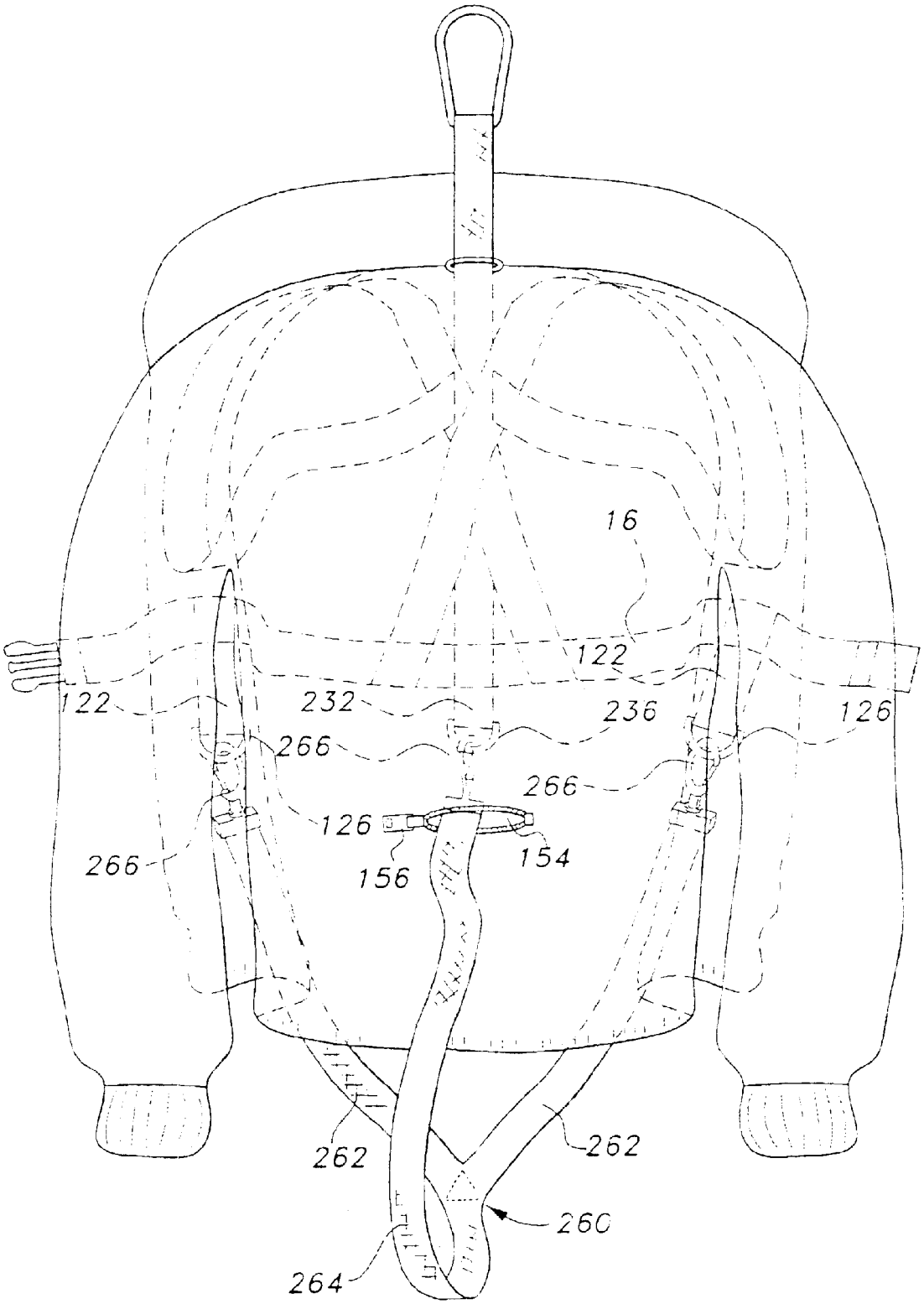
FIG. 24B is an a rear elevation view of the jacket of FIG. 16 having the "Y"-shaped crotch strap reversed with the single crotch strap attached at a rear support ring and the two crotch straps attached to left and right front mounted attachment strap rings.

Referring to FIG. 24B, there is shown another embodiment of the inventive safety jacket similar to that as shown in FIG. 19 having a "Y"-shaped crotch strap 260 as in FIG. 24A, above, the crotch strap 260 being attached in reverse fashion with the single strap 264 in the rear and the two straps 262 attached at the front of the jacket. A single attachment strap 122 is extended from the rear center of belt 16 supporting attachment ring 126. Attachment straps 122 are attached to belt 16 at each side of the front of the jacket and support respective attachment rings 126. The single rear strap 264 is attached to the single rear attachment ring 236 by insertion through opening 154 and attachment of snap hook 266. Opening 154 has zipper 156 for closure of opening 154 when the crotch strap is not used. The two front straps 262 are attached to respective attachment rings 132 at each side of the front of the jacket by means of snap hooks 266.

Although the various waist, and upper torso straps are shown as fixedly attached to the shoulder straps and safety strap, the waist and upper torso straps may be threaded through loops formed in the shoulder straps and safety strap to aid in adjustment for wearers of differing sizes as illustrated in the shoulder straps of FIG. 20. The length of the various belts and straps may also be adjusted in length by buckle connections (not shown) in a well known manner.

It is to be understood that the present invention is not limited to the sole embodiments described above, but encompasses any and all embodiments within the scope of the following claims.

I claim:

1. A safety garment for industrial purposes or hunting including a safety jacket, coat, or vest including:

an outer layer, an inner layer, and a safety harness;

said inner layer having an outer surface and an interior surface;

said inner layer being selectively worn independent of said outer layer;

said outer layer defining an exterior and interior surfaces;

said safety harness being disposed on said interior surface of said inner layer;

said safety harness having front and rear portions and a safety strap reversibly extendible from the rear portion of said safety harness and through an opening located in said outer layer of said garment, said safety strap having a safety loop or ring securely fastened to a free end thereof;

said safety ring being configured to couple with a safety line.

2. The safety garment of claim 1, said safety harness comprising a waist belt portion for extending around a user's waist, a pair of shoulder loops for extending over a wearer's shoulders and defining front and back shoulder loop portions, said waist belt portion having a coupler located between said front loop portions for selectively securing said safety harness, said back loop portions being crossed and forming a juncture connection, said safety harness safety strap being securely fastened to said juncture connection and to said belt portion located at approximately the spine of the wearer.

3. The safety garment of claim 2, said safety strap having a lower extension below said waist belt for supporting a ring or loop to receive one of leg loop/crotch straps or a deer drag.

4. The safety garment of claim 3, wherein said back loop portions are crossed at said juncture and are looped over said waist belt.

5. The safety garment of claim 4, further comprising an adjustable underarm strap extending laterally and connecting each respective front portion of said shoulder straps and looped over corresponding rear shoulder straps.

6. The safety garment of claim 5, further comprising a front upper belt portion spaced above said waist belt and extending between respective front portions of said shoulder strap, said front upper belt portion having a coupler located between said front loop portions for selectively securing said safety harness.

7. The safety garment of claim 3, said safety harness further comprising a plurality of attachments to said waist belt for receiving at least one of a plurality of accessories including removable leg loop/crotch straps, fanny pack, backpack and deer drag said attachments.

8. The safety garment of claim 7, further comprising leg loops for selective attachment to said waist belt.

9. The safety garment of claim 8, further comprising selectively reversible pants or trousers having opposing sides, said leg loops being attached to said trousers, said leg loops have attachment rings attached to and extending upward from said leg loop/crotch straps for attachment to said waist belt attachments.

10. The safety garment of claim 9, wherein said safety harness is attached to said interior surface of said vest as by sewing, hook and loop material, or adhesive.

11. The safety garment of claim 3, wherein said safety harness is attached to said interior surface of said outer layer or shell as by sewing, hook and loop material, or adhesive.

12. The safety garment of claim 7, wherein said plurality of attachments each include an attachment strap attached at an upper end to said waist belt and an attachment ring or loop attached at a lower end thereof.

13. The safety garment of claim 12, wherein there is an attachment located on said waist belt near each of its respective ends and proximate said coupler at the front of said jacket.

14. The safety garment of claim 13, further comprising a "Y"-shaped crotch strap having a single strap integral with a pair of straps, said single strap attached to said ring or loop of said lower extension of said safety strap and the said pair of straps attached to said ring or loop of said respective attachments at the front of said jacket.

15. The safety garment of claim 14, wherein said outer layer defines a single, centrally located opening therethrough below said safety strap for receiving said single strap, said opening being selectively closable by a zipper.

16. The safety garment of claim 15, wherein said straps of said "Y"-shaped crotch strap are respectively attached to said loops or rings by snap hooks.

17. The safety garment of claim 3, further comprising a pair of leg loops having straps attached to said loop or ring of said safety strap lower extension.

18. The safety garment of claim 17, wherein said outer layer defines a single, centrally located opening therethrough below said safety strap for receiving said pair of leg loops, said leg loops being attached to said loop or ring by snap hooks.

19. The safety garment of claim 3, wherein said outer layer of said jacket defines a centrally located slit and said safety strap extension extends through said centrally located slit.

20. The safety garment of claim 7, further comprising a pair of attachments to said waist belt attached at opposite sides and spaced from said safety strap extension and having respective depending straps and loops or rings, and wherein said outer layer of said jacket defines slits therethrough corresponding to said pair of attachments, said safety strap extension and said depending straps extending through respective slits in said outer layer of said jacket.

21. The safety garment of claim 20, in combination with a fanny pack having spaced snap hooks and a coupling belt, said snap hooks being spaced so as to attach to respective said loops or rings of said pair of attachments.

22. The safety garment of claim 2, further comprising a pair of attachment straps depending from said waist belt in the back portion of said jacket and spaced from said safety strap and having attachment loops or rings and a pair of crotch straps attached at one end to a said respective loop or ring and defining a respective loop at the other end so as to removably slide over respective coupler portions of said waist belt in the front of said jacket for mounting on said waist belt at the front of said jacket.

23. The safety garment of claim 22, said outer layer defining a pair of openings therethrough below said attachment straps for separately receiving said pair of leg loop straps, said leg loop straps being attached to said loops or rings by snap hooks, said openings having zippers for closure thereof when not in use.

24. The safety garment of claim 2, further comprising lower extensions of said shoulder belts extending below said waist belt at the back of said jacket and leg loops having straps removably attached with said shoulder belts by respective couplers.

25. The safety garment of claim 24, said outer layer defining a pair of openings therethrough below and in line with said shoulder belt extensions for separately receiving said pair of leg loop straps.

26. The safety garment of claim 2, further comprising upper torso extensions attached to said respective shoulder straps having a coupler for attachment around the wearer's upper torso.

27. The safety garment of claim 2, said safety harness further comprising a plurality of attachments to said waist belt for receiving at least one of a plurality of accessories including removable leg loop/crotch straps, fanny pack, and deer drag said attachments.

28. The safety garment of claim 27, wherein said plurality of attachments each include an attachment strap attached at an upper end to said waist belt and an attachment ring or loop attached at a lower end thereof.

29. The safety garment of claim 28, wherein there is an attachment located on said waist belt near each of its respective ends and proximate said coupler at the front of said jacket and there are a pair of attachments located on said waist belt respectively spaced from each side of said safety strap at the back of said jacket.

30. The safety garment of claim 29, further comprising a "Y"-shaped crotch strap having a single strap integral with a pair of straps, said pair of straps being respectively attached to said pair of attachments located at the back of said jacket and the said single strap attached to one of said ring or loop of said attachments at the front of said jacket.

31. The safety garment of claim 30, wherein said outer layer defines a respective pair of openings therethrough below said pair of attachments for receiving said single strap, each said opening being selectively closable when not in use by respective zippers.

32. The safety garment of claim 30, wherein said straps of said "Y"-shaped crotch strap are respectively attached to said loops or rings by snap hooks.

33. The safety garment of claim 1, said safety harness comprising a waist belt portion for extending around a user's waist, a pair of shoulder loops for extending over a wearer's shoulders and defining front and back shoulder loop portions, said waist belt portion having a coupler located between said front loop portions for selectively securing said safety harness, said safety harness further comprising an upper torso belt portion spaced above said waist belt portion and extending around the user's upper torso, said upper torso belt being attached to each said shoulder strap at both front and rear portions thereof, said safety strap portion being attached to said safety harness at the back thereof to said waist belt portion and said upper torso belt portion.

34. The safety garment of claim 33, said safety strap having a lower extension below said waist belt for supporting a ring or loop to receive one of leg loop/crotch straps or a deer drag.

35. The safety garment of claim 34, wherein said outer layer of said jacket defines a centrally located back slit and said safety strap extension extends through said centrally located slit.

36. The safety garment of claim 35, further comprising a pair of attachments to said waist belt attached at opposite sides and spaced from said safety strap extension and having respective depending straps and loops or rings, and wherein said outer layer of said jacket defines back slits therethrough corresponding to said pair of attachments, said safety strap extension and said depending straps extending through said respective slits in said outer layer of said jacket.

37. The safety garment of claim 33, said rear portions of said shoulder straps each having a lower extension below said waist belt for supporting a ring or loop to receive one of leg loop/crotch straps, additional tethers, or a deer drag.

38. The safety garment of claim 37, wherein said outer layer of said jacket defines two spaced-apart back slits below said waist belt and said shoulder strap extensions extend through respective said slits.

39. The safety garment of claim 33, said rear portion of said shoulder straps each having an attachment strap attached at said upper torso belt and supporting an attachment loop or ring to receive one of leg loop/crotch straps, additional tethers, or a back pack.

40. The safety garment of claim 39, wherein said outer layer of said jacket defines two spaced-apart back slits below said upper torso belt and said attachment straps extend through respective said slits.

41. The safety garment of claim 7, wherein said leg loops include a single leg loop strap looped over said waist belt.

42. The safety garment of claim 7, wherein a single strap serves as two leg loop/crotch straps and said single strap is supported by a single attachment belt attached to said waist strap and supporting said single attachment belt by a loop therein.

43. The safety garment of claim 7, wherein a single attachment belt attached to said waist belt supports a single attachment ring, two leg loop straps being attached to said single attachment ring by respective snap hooks.

* * * * *